United States Patent [19]

Gegel et al.

[11] Patent Number: 4,617,817

[45] Date of Patent: Oct. 21, 1986

[54] OPTIMIZING HOT WORKABILITY AND CONTROLLING MICROSTRUCTURES IN DIFFICULT TO PROCESS HIGH STRENGTH AND HIGH TEMPERATURE MATERIALS

[75] Inventors: Harold L. Gegel, Kettering; James C. Malas, Dayton; Yellapregada V. R. K. Prasad, Fairborn; Sokka M. Doraivelu, Beavercreek; Douglas R. Barker, Centerville; James T. Morgan, Jr., Huber Heights; Kristine A. Lark, Enon, all of Ohio

[73] Assignee: The United States of America as represented by the Secretary of the Air Force, Washington, D.C.

[21] Appl. No.: 698,728

[22] Filed: Feb. 6, 1985

[51] Int. Cl.[4] ..... B21J 5/00

[52] U.S. Cl. ..... 72/364; 72/377; 148/11.5 R

[58] Field of Search ..... 148/11.5; 420/902; 72/377, 364, 700

[56] References Cited

U.S. PATENT DOCUMENTS

| | | | |
|---|---|---|---|
| 3,340,101 | 9/1967 | Fields, Jr. et al. | 148/11.5 R |
| 3,469,433 | 9/1969 | Fresch et al. | 72/364 |
| 3,519,503 | 7/1970 | Moore et al. | 148/11.5 |
| 3,772,090 | 11/1973 | Allen et al. | 148/11.5 |
| 3,975,219 | 8/1976 | Allen et al. | 420/902 |
| 4,106,956 | 8/1978 | Bercovici | 148/11.5 A |
| 4,375,375 | 3/1983 | Giamei et al. | 148/11.5 F |

OTHER PUBLICATIONS

Rishi Raj, "Development of a Processing Map for Use in Warm-Forming and Hot Forming Processes", Metall Trans 12A, 1089-1097, (1981).

C. Gandhi and M. F. Ashby, "Fracture-Mechanism Maps for Materials which Cleave: F.C.C., B.C.C., and H.C.P. Metals and Ceramics", Acta Metall 27, 1565-1602, (1979).

H. H. Heinemann, *Flow Stress of Different Aluminum and Copper Alloys for High Strain Rates and Temperatures,* (1961).

Rudolf Akeret, "Untersuchungen uber das Umformverhalten von Aluminumwerkstoffen bei Verschiedenen Temperaturen", Z Metallk 61, 3-10, (1970).

M. J. Luton and C. M. Sellars, "Dynamic Recrystallization in Nickel and Nickel-Iron Alloys during High Temperature Deformation", Acta Metall 17, 1033-1060, (1969).

J. M. Jacquerie and L. Habraken, "Contribution to the Study of the Resistance of Cobalt to Plastic Flow at High Temperature", Cobalt 38, 13-19, (1968).

R. Bromley, *The High Temperature Deformation of Copper and Copper-Aluminum Alloys,* PhD Dissertation, (1969).

J-P. A. Immarigeon and J. J. Jonas, "The Deformation of Armco Iron and Silicon Steel in the Vicinity of the Curie Temperature", Acta Metall 22, 1235-1247, (1974).

Hans Buhler and Hals Wilfried Wagener, "Die Staucheigenschaften von Zirkonium und Zircaloy-2", Z Metallk 58, 136-144, (1967).

M. Doner and H. Conrad, "Deformation Mechanisms in Commercial Ti-50A", Metall Trans 4A, 2809-2817, (1973).

T. E. O'Connell and D. M. Marczik, "Production of Titanium Aluminum Products", FR-13378, p. 13, (1980).

*Primary Examiner*—Lowell A. Larson

*Attorney, Agent, or Firm*—Bobby D. Scearce; Donald J. Singer

[57] ABSTRACT

An improved hot forming method for metals, alloys and the like, and in particular, for difficult to process high strength and high temperature metals and alloys of particular use in aerospace applications, is described, which comprises the steps of generating flow stress data as a function of strain rate and temperature on samples of the material at predetermined strain within predetermined ranges of temperature and strain rate; determining from that data the strain rate sensitivity and power dissipation efficiency of the material within the ranges of temperature and strain rate represented by the generated data; selecting values of strain rate and corresponding temperature for a selected value of the dissipation efficiency for the material; and hot forming the material at the selected strain rate and temperature values to a predetermined shape. The improved method may be of particular application to forging, extrusion, rolling or other hot forming process appropriate for titanium, aluminum, nickel, cobalt, copper, iron, zirconium and their alloys. A processing map for hot forming each metal or alloy may be generated according to the methods taught.

40 Claims, 38 Drawing Figures

OPTIMIZING HOT WORKABILITY AND CONTROLLING MICROSTRUCTURES IN DIFFICULT TO PROCESS HIGH STRENGTH AND HIGH TEMPERATURE MATERIALS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to processes for hot forming materials, and more particularly to a novel process for hot working high strength, high temperature materials wherein process parameters are optimized and control of microstructure may be maintained during processing according to a predetermined scheme. The methods taught herein may be applied to substantially any flowing solid under stress and are particularly useful in hot forming difficult to shape metals and alloys of relevance to advanced aerospace technology.

In prior art hot metal forming processes each metal or alloy of specified heat treat history must be tested by trial and error for optimum hot workability parameters associated with extrusion, forging, rolling, machining or other processing technique intended for use in fabricating an article from that particular metal or alloy. In current manufacturing environments this procedure is extremely costly and time consuming because a large number of tests must be conducted to establish the workability parameters for forming the article. A change in geometry, die design, or manufacturing process often necessitates repeat of the associated workability tests.

Advanced aluminum, iron, titanium and nickel based alloys produced by conventional ingot metallurgy, and rapid solidification technology alloys having unique and complex composition, microstructure and mechanical properties have been developed, which are characterized by good oxidation resistance, low density and other favorable properties for high temperature application. Both advanced ingot metallurgy alloys and rapid solidification powder metallurgy alloys are, however, characterized by poor hot workability. In order to improve the cost effectiveness of hot forming processes for these alloys, process modelling is desirable to predict and characterize the real material behavior during forging, extrusion, rolling, sheet metal forming, and the like, as might be selected for processing a particular alloy, by defining in advance the response of the alloy to the demands of the selected process. It is a purpose of the present invention to develop the modelling into an analytical scheme that realistically represents the materials behavior in processing to achieve microstructural control in the material comprising the product.

Existing models for predicting response of a material to the intended manufacturing process include processing maps developed by Raj (R. Raj, Metall Trans 12A, 1089 (1981); R. Raj, *Deformation Processing Maps,* ASM, Metals Park, OH (in press)), along the lines of the deformation and fracture maps of Ashby (H. J. Frost and M. F. Ashby, *Deformation Mechanism Maps,* Pergamon Press, New York (1982); C. Gandhi and M. F. Ashby, Acta Metall 27, 1565 (1979)), which are valuable in avoiding cavitation at hard particles and wedge cracking at grain boundary triple junctions. A typical Raj map is shown in FIG. 1 for aluminum. FIG. 1 presents a plot of strain rate versus temperature which exhibits limiting conditions for cavity formation at hard particles, which dominates in low temperature and high strain rate region 10 above boundary 11, as well as those for wedge cracking at grain boundary triple junctions, which dominate in high temperature and low strain rate region 12 below boundary 13. Boundaries 11,13 were obtained on the basis of micromechanisms involved in nucleation of the damage processes. The limiting conditions for flow localization due to adiabatic heating may comprise region 14 defined above boundary 15. A region 17 defined between boundaries 13,18 may be characterized by the dominance of dynamic recrystallization within the microstructure. When these mechanisms are taken into account, a region 16 defined between boundaries 11,13,15 may be considered as "safe" for processing using combinations of temperature and strain rate included therein for ductility maxima. In analytical simulations the solution domain can be restricted to the "safe" region 16, but optimization and control of the microstructure can only be gained through the use of atomistic models. For example, region 17 corresponding to the process of dynamic recrystallization has been so delineated on the basis of a kinetic model. This approach to materials process control has two limitations: (1) since it is based on atomistic theory, it is difficult to integrate with the continuum approach of the finite element techniques, and (2) it is not always possible to identify the atomistic mechanisms unequivocally in all materials, particularly in complex alloys.

In the control of the microstructure of a material during hot working, the conditions which the forming process demand that the workpiece material withstand must be outlined, and the response of the workpiece material to the demands imposed by the process must be defined. Thus, the need exists for a dynamic materials model for processing which forms a link between the atomistic and continuum models and, at the same time, is of use in defining optimum process parameters.

The present invention provides a process to define and characterize the predicted response of the workpiece material to the process demands, in order to optimize hot workability of the material. Shaped parts of substantially any engineering material, including high strength, high temperature powder metallurgy alloys, and other difficult to fabricate aerospace materials, may be produced by hot working processes wherein microstructures, mechanical properties and defects of the material may be precisely controlled. The novel process includes selection of optimum processing parameters from energy dissipation maps generated from inelastic constitutive equation data for the workpiece material which describe its flow behavior as a function of temperature, strain, and strain rate, and describe the efficiency of power dissipation by the workpiece in the form of favorable metallurgical processes that enhance both hot workability and mechanical properties in the product. In the context of the teachings of the present invention, workability is broadly defined as the response of the material to the demands of the metalworking processes (forging, extrusion and the like) and is expressed as the ability of the material to dissipate energy through favorable metallurgical processes. The temperature and strain rate values selected from the energy dissipation map for the workpiece material are determinative of the optimum rate at which energy may be input into the workpiece in order to hot form the material through desirable metallurgical processes without fracture, to ameliorate the effects of pre-existing defects in the workpiece material, and to obtain a desired microstructure in the component consistent with prescribed engineering properties for the product.

It is, therefore, a principal object of the present invention to provide a novel method for hot working material wherein the process parameters for hot working are optimized.

It is a further object of the invention to provide a method for predicting optimum process parameters for hot working a material.

It is yet another object of the invention to provide a process control map for optimizing hot working parameters for a material.

It is yet a further object of the invention to provide a process to precisely predict the behavior of a material to achieve microstructural control in a hot formed product.

These and other objects of the present invention will become apparent as the detailed description of certain representative embodiments thereof proceeds.

SUMMARY OF THE INVENTION

In accordance with the foregoing principles and objects of the invention, an improved hot forming method for metals, alloys and the like, and in particular, for difficult to process high strength and high temperature metals and alloys of particular use in aerospace applications, is described, which comprises steps of generating flow stress data as a function of strain rate and temperature on samples of the material at predetermined strain within predetermined ranges of temperature and strain rate; determining from that data the strain rate sensitivity and power dissipation efficiency of the material within the ranges of temperature and strain rate represented by the generated data; selecting values of strain rate and corresponding temperature for a selected value of the dissipation efficiency for the material; and hot forming the material at the selected strain rate and temperature values to a predetermined shape. The improved method may be of particular application to forging, extrusion, rolling or other hot forming process appropriate for titanium, aluminum, nickel, cobalt, copper, iron, zirconium and their alloys. A processing map for hot forming each metal or alloy may be generated according to the methods taught.

DESCRIPTION OF THE DRAWINGS

The invention will be more clearly understood from the following detailed description of representative embodiments thereof read in conjunction with the accompanying drawing figures wherein.

DETAILED DESCRIPTION

Mathematical Analysis

Figure 1:
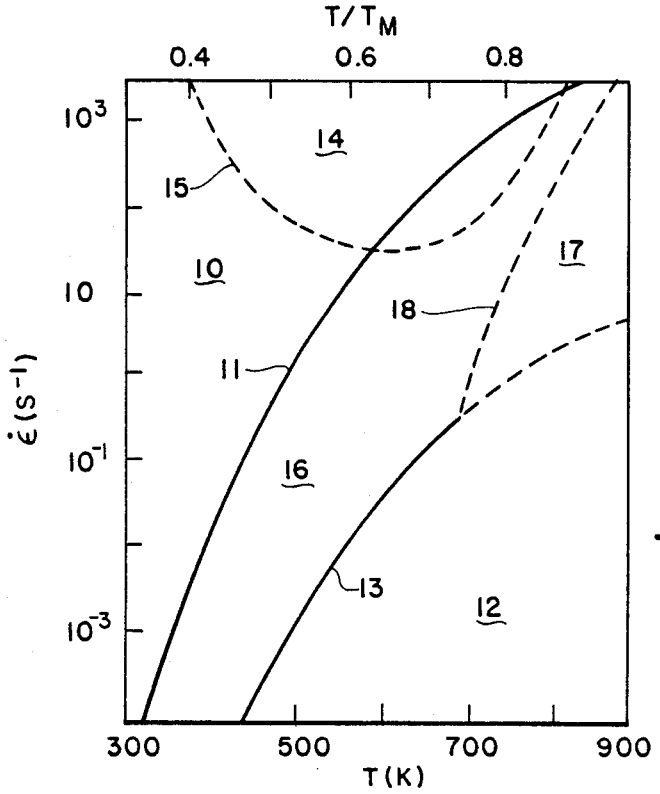
Fig. 1 Prior Art
FIG. 1 is a prior art processing map for aluminum.
Figure 2:
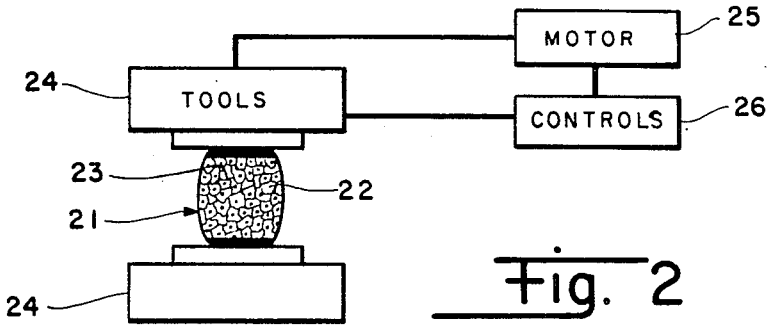
FIG. 2 is a schematic of a generallized processing system for hot forming an article according to the present invention.

The present invention comprises a method of forming materials wherein optimizing workability and obtaining controlled microstructure in difficult to shape materials are accomplished by controlling the temperature and strain rate during processing of a well lubricated billet of the material. In the method of the present invention, metalworking is viewed as a system in which certain elements are sources and stores of energy while the workpiece itself is the basic device for dissipating energy. Consider the schematic processing scheme presented in FIG. 2. Workpiece 21 may comprise an article of manufacture to be hot formed by forging, extrusion, or other metalworking process, from material 22 characterized by hot workability under stress, such as a metal or alloy, having microstructure 23. Material 22 may be acted upon in any hot forming process, as might occur to one with skill in the field of this invention, by tool system 24 powered by motor 25 or other source of power controlled by controller 26. Workpiece 21 dissipates power during the hot forming process as viscoplastic heat and through irreversible metallurgical processes at work within material 22 and manifested as dynamic microstructural changes.

According to the present invention, a model is defined to express the constitutive behavior of material 22 as an analytical relationship of variation of flow stress with certain process variables, namely, temperature and strain rate. The constitutive equation describes the manner in which energy applied to workpiece 21 from a store of power represented by tools 24 is dissipated by dynamic metallurgical processes within workpiece 21. For example, in a forging process, instantaneous power will be provided to the workpiece 21 as described by:

$$\bar{\sigma}\dot{\bar{\epsilon}}=\sigma_1\dot{\epsilon}_1+\sigma_2\dot{\epsilon}_2+\sigma_3\dot{\epsilon}_3 \tag{1}$$

where $\bar{\sigma}$ is the effective stress, $\dot{\bar{\epsilon}}$ is the effective strain rate, and the terms on the right side of Equation (1) are the products of principal stresses and principal strain rates within workpiece material 22.

Workpiece 21 will dissipate the instantaneous power supplied by the mechanical metalworking system (tools 24) by a metallurgical process which is commensurate with the power level supplied. For example, fracture processes dissipate energy most efficiently when energy is supplied at a very high rate. Metallurgical processes, such as superplastic flow, dissipate energy with correspondingly high efficiency, but the energy must be supplied by tools 24 at lower, more controlled rates in order to promote the desired metallurgical process(s).

Figure 3A:
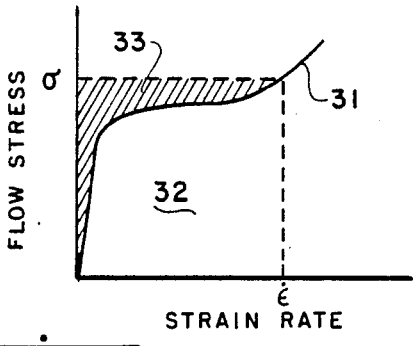
FIG. 3*a* is a graphic representation of the constitutive relation between flow stress and strain rate for a simple dissipator.

A typical constitutive relation for a simple dissipator is illustrated graphically in FIG. 3*a* wherein flow stress (effort) is shown as a function 31 of strain rate (flow) at constant temperature and strain. At any given strain rate and corresponding stress (as represented by respective values at the dotted lines), the instantaneous power P absorbed by the workpiece during plastic flow is given by:

$$\sigma\dot{\epsilon} = \int_0^{\dot{\epsilon}} \sigma d\dot{\epsilon} + \int_0^{\sigma} \dot{\epsilon} d\sigma \tag{2}$$

or, $$P=G+J \tag{3}$$

In FIG. 3*a*, the area 32 below curve 31 is defined as the dissipator content G, and is equal to the value of the first integral on the right side of Equation (2), and the area 33 above curve 31 is the dissipator co-content J and is equal to the value of the second integral on the right side of Equation (2). The term G represents the power dissipated by plastic work most of which is converted into viscoplastic heat, the remaining small part being stored as lattice defects. The dissipator power co-content J is related to the metallurgical mechanism which occur dynamically to dissipate power. The dynamic material behavior can be modelled explicitly wherein the power co-content J is expressed as a function of certain process parameters. Accordingly, from Equations (2) and (3), it can be shown that at any given strain rate and temperature.

$$\left.\frac{\partial J}{\partial G}\right|_{T,\epsilon} = \left.\frac{\partial \ln\sigma}{\partial \ln\dot{\epsilon}}\right|_{T,\epsilon} \tag{5}$$

which is defined as the strain rate sensitivity m of the material:

$$m = \left.\frac{\partial \ln\sigma}{\partial \ln\dot{\epsilon}}\right|_{T,\epsilon} \simeq \left.\frac{\Delta \log\sigma}{\Delta \log\dot{\epsilon}}\right|_{T,\epsilon} \tag{5}$$

From Equations (4) and (5), it follows that the empirical relationship between strain rate and stress at any temperature may be expressed as:

$$\dot{\epsilon}=A\sigma^{1/m} \quad (6)$$

where A is a constant. In the hot working range for pure metals, m is temperature and strain rate independent, but in complex alloy systems, m may vary substantially with temperature and strain rate.

At any given deformation temperature, strain rate and strain, J may be evaluated by integrating Equation (6) between flow stress limits O and $\sigma$, viz:

$$J = \int_0^{\sigma} \dot{\epsilon} d\sigma = \frac{A\sigma^{(1+m)/m}}{(1+m)/m} \quad (7)$$

Combining Equations (6) and (7), shows J to be related to the strain rate sensitivity as:

$$J=\sigma\dot{\epsilon}m/(m+1) \quad (8)$$

In this integration, the strain rate dependence of m represents the flow trajectory taken by the system to reach flow stress $\sigma$; according to the variational principle, this will be the path which provides the maximum dissipation of J. The value of J at a given temperature and strain rate may be estimated from the flow stress and strain rate sensitivity factor m. Further, J reaches its maximum ($J_{max}$) when m=1 (curve 35 of FIG. 3*b*) and the workpiece acts as a linear dissipator. Thus, $$J_{max}=\sigma\dot{\epsilon}/2 \quad (9)$$

Figure 3B:
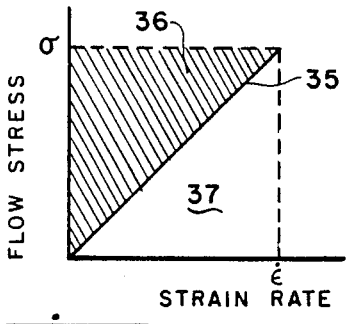
FIG. 3*b* is a graphic representation of the constitutive relation between flow stress and strain rate for a dissipator having a strain rate sensitivity equal to unity.

In this case, as shown in FIG. 3*b*, one half the power is dissipated through dynamic metallurgical softening processes as represented by the cross hatched area 36 ($J_{max}$) above curve 35, and the other half is dissipated as viscous heat, as represented by area 37 below curve 35. The behavior of superplastic materials approaches this extreme. The other extreme occurs for materials which are strain insensitive and those which do not flow, in which cases J is zero. By normalizing J with respect to $J_{max}$, the power dissipation ability of the materials may be expressed in terms of power dissipation efficiency $\eta$ defined as the ratio of J to $J_{max}$:

$$\eta = \frac{J}{J_{max}} = \frac{2m}{m+1} \quad (10)$$

The power dissipation efficiency is a measure of the ability of the workpiece material to dissipate power through metallurgical processes, and provides a controlling parameter in defining the contours of the energy dissipation maps of the present invention.

Energy Dissipation Maps

Several dynamic metallurgical processes contribute to power dissipation during hot working of materials, and each of these processes has its characteristic efficiency of dissipation. The following processes are examples: dynamic recovery, dynamic recrystallization, dissolution and growth of particles, spheroidization of acicular structures, flow-induced phase transformation, strain hardening, precipitation from a metastable phase, grain growth, superplasticity, dynamic strain aging, void formation at hard particles (ductile fracture), fracture, and wedge cracking at grain boundary triple junctions. Fracture processes, though ordinarily undesirable, represent the most efficient means to dissipate power put into a workpiece.

In materials having complex microstructures such as two-phase alloys, dispersion strengthened materials, rapid solidification alloys and intermetallics, two or more of these mechanisms may occur simultaneously and/or interactively. The value of J will be the overall result of the simultaneously occuring mechanisms. If two mechanisms have an opposing effect on power dissipation, J will reach a peak when the energy of dissipation of one process equals that of the other. For processing of materials, the most favorable conditions are those which provide the highest J dissipated in the most efficient fashion (highest $\eta$) without onset of internal fracture. These parameters are used in optimization and control of microstructures in metalworking processes according to the present invention. When $\eta$ is plotted as a function of temperature and strain rate (processing maps), the resulting surface represents the variation of the rate of excess entropy production in the system. The complexity of the surface will depend on the number of processes which can occur in a given temperature and strain rate range. The processing map for a particular material will vary somewhat depending on the heat treat or other processing history of the material comprising the workpiece, as discussed herein.

In the analysis of hot deformation stress versus strain rate data for the generation of a processing map for a particular material according to the present invention, the variation of flow stress (at a constant strain) with strain rate is fitted to a third order polynomial of the form, $$\log \sigma=a+b(\log \dot{\epsilon})+c(\log \dot{\epsilon})^2+d(\log \dot{\epsilon})^3 \quad (11)$$

where a, b, c, and d are constants. The strain rate sensitivity is evaluated from Equation (11) and the definition of m as a function of strain rate and temperature (Equation (5)). Efficiency variations calculated from the strain rate sensitivity values are then plotted in three dimensions, in the form of a contour map on a strain rate versus temperature plot in which each contour represents a constant efficiency value.

For the experimental evaluation of J and $\eta$, the strain rate sensitivity and flow stress as a function of temperature, strain rate and strain are obtained from uniaxial compression or tensile tests conducted at a constant temperature and strain rate for each workpiece material and heat treat history.

The energy dissipation maps may be interpreted by examining the microstructures of specimens corresponding to prominent regions of the map. Certain features in these microstructures will reflect the dynamic state of the material, even though in principle it is not possible to freeze any dynamic state of matter. As a general proposition, in the low-temperature (less than about one half the temperature (K.) of melting, i.e., 0.5 $T_m$), high strain rate change (about 0.1 to 10 $s^{-1}$), the maps indicate that void formation occurs at hard particles, which leads to ductile fracture; these regions are characterized by rapid increase in efficiency with decrease in temperature and should be avoided in processing. In the high temperature (greater than about 0.75 $T_m$), low strain rate (less than about 0.001 $s^{-1}$) range, wedge cracking caused by grain boundary sliding occurs (except in superplastic materials in which wedge cracking is minimum); this region is characterized by increase in efficiency of dissipation with decrease in strain rate, and should also be avoided in processing. In the high temperature (greater than about 0.7 $T_m$), high strain rate (about 0.1 to 10 $s^{-1}$) range, dynamic recrystallization dominates. At intermediate temperatures and strain rates, the dynamic recovery process dominates. At very high strain rates (greater than 10 $s^{-1}$) and high temperatures (greater than about 0.7 $T_m$), an adiabatic shear process may occur which is undesirable in processing.

The type and dominance of hot deformation mechanism occurring in a given temperature and strain rate range will vary from material to material, and may vary substantially for a specified metal or alloy depending upon its particular heat treat and processing history and upon the type and composition of alloying constituents. Further, the range of efficiency by which the power input to the workpiece material is dissipated by each mechanism may vary substantially within the same material. For example, in a processing map for aluminum (see generally FIGS. 9a–13b and associated text infra), in a region where strain hardening is the dominant mechanism, the range of efficiency will ordinarily be less than 5%, as most of the power is dissipated as viscoplastic heat and in the generation of atomic defects; where dynamic recovery dominates, the efficiency will be 10–20% characterized by dislocation annihilation by climb and cross slip in the microstructure; where dynamic recrystallization dominates, the efficiency will ordinarily be about 30% and generally increases with increasing strain rate until instability in the microstructure occurs; where ductile fracture dominates, the efficiency range will ordinarily be greater than about 35% and decreases with increasing temperature since this is characteristically a low temperature, high strain rate process; where wedge cracking dominates, the efficiency range will ordinarily be greater than about 35% and increases with increasing temperature and decreasing strain rate until grain growth occurs since this is characteristically a high temperature, low strain rate process; where superplasticity dominates, the efficiency will ordinarily be near 100%, however, since some wedge cracking occurs, the two cannot be totally separated; where dynamic strain aging dominates, the efficiency will ordinarily be zero (or less) since the material acts as a power store.

In addition, effects of phase and magnetic transformations are thermodynamic in nature and contribute to large changes in the internal entropy of the system. If a combination of temperature and strain rate exists which creates flow instability, the energy dissipation maps will reveal this tendency. For example, such a situation may develop at temperatures close to the melting point (about 0.9 $T_m$) and very high strain rates (greater than 10 $s^{-1}$).

In the following discussion of representative metallic systems, the interpretations follow the foregoing guidelines, supported by microstructural studies. The representative systems examined in demonstration of the invention include the alloy systems Ti-6242, 2024 aluminum, 2024 aluminum (20 v/o SiC whiskers), IN-100, RENE-95 and titanium aluminide, and the substantially pure metal systems including aluminum, nickel, cobalt, copper, $\alpha$-iron, zirconium, and titanium, although the representative dynamic models presented characterizing metals in the high temperature and strain rate range are not all inclusive of the systems within the scope of the present invention. Similar dynamic models may be developed to define the behavior of complex alloys, powder metallurgical materials, ceramics, and substantially any other solid material characterized by hot flow under stress.

Representative Systems

Ti-6242 Alloy: Consider first the alloy system Ti-6242 (m.p. 1873–1948° K. approx). This material comprises 6 wt% aluminum, 2 wt% tin, 4 wt% zirconium, 2 wt% molybdenum, and 0.15 wt% silicon, and is a near $\alpha$, $\alpha+\beta$ alloy having hot working characteristics very sensitive to the initial preform microstructure and processing variables. Two preform microstructures were investigated within these teachings: equiaxed ($\alpha+\beta$), and acicular ($\alpha+\beta$), also called transformed $\beta$. The transformed $\beta$ preform exhibits flow softening (flow stress decreases with increasing strain) during hot deformation and the material passes through a series of dissipated energy states (representing various deformed microstructures) before approaching near equilibrium ($\alpha+\beta$) microstructure. By starting with a transformed $\beta$ microstructure preform of "tapered disk" configuration, a dual microstructure was obtained in the disk by hot forging in a controlled fashion. The bore region of the disk had near equilibrium ($\alpha+\beta$) microstructure since this region undergoes larger strain, while the rim had an acicular ($\alpha+\beta$) structure similar to the starting preform microstructure. A microstructural gradient characterized the material between the rim and bore. The equiaxed ($\alpha+\beta$) structure in the bores had good low cycle fatigue and tensile and fracture toughness properties while the acicular ($\alpha+\beta$) structure in the rim had good creep and stress rupture properties. The optimum temperature and strain rate at which forging is done may be obtained using the method of the present invention, the details of which presented herein are representative of other material systems to which the invention is applicable.

Figure 4:
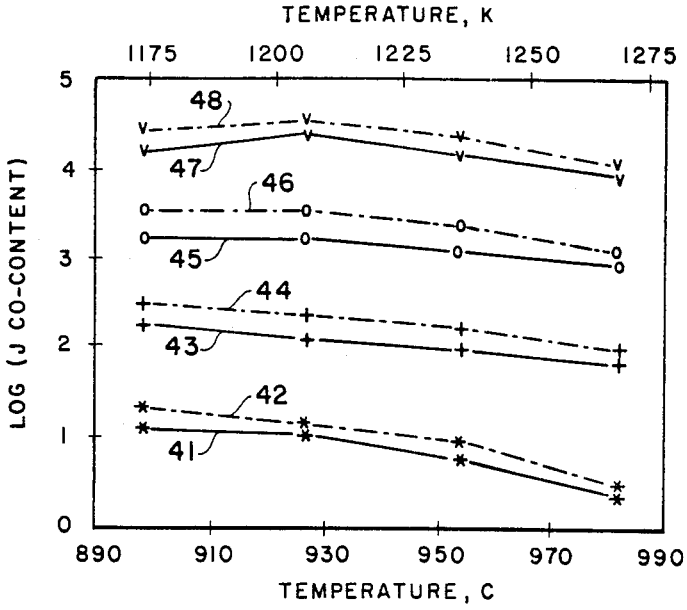
FIG. 4 graphs J co-content versus temperature for various strain rates in Ti-6242 $\beta$ preform.
Figure 5:
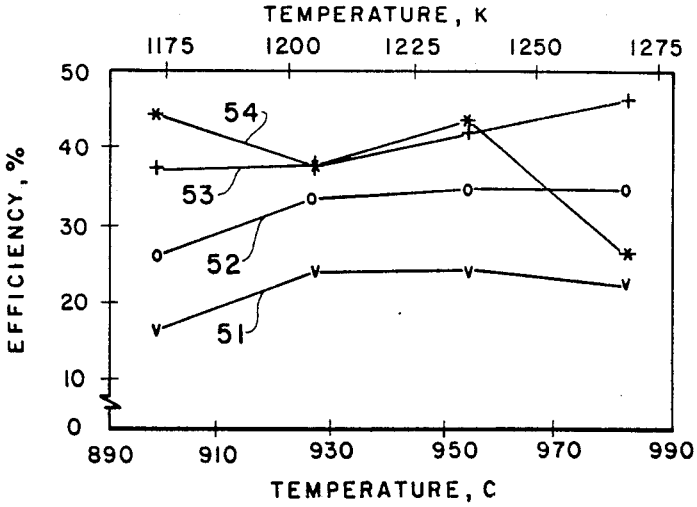
FIG. 5 graphs dissipation efficiency versus forging temperature for Ti-6242 $\beta$ preform at 0.04 strain for various strain rates.
Figure 6B:
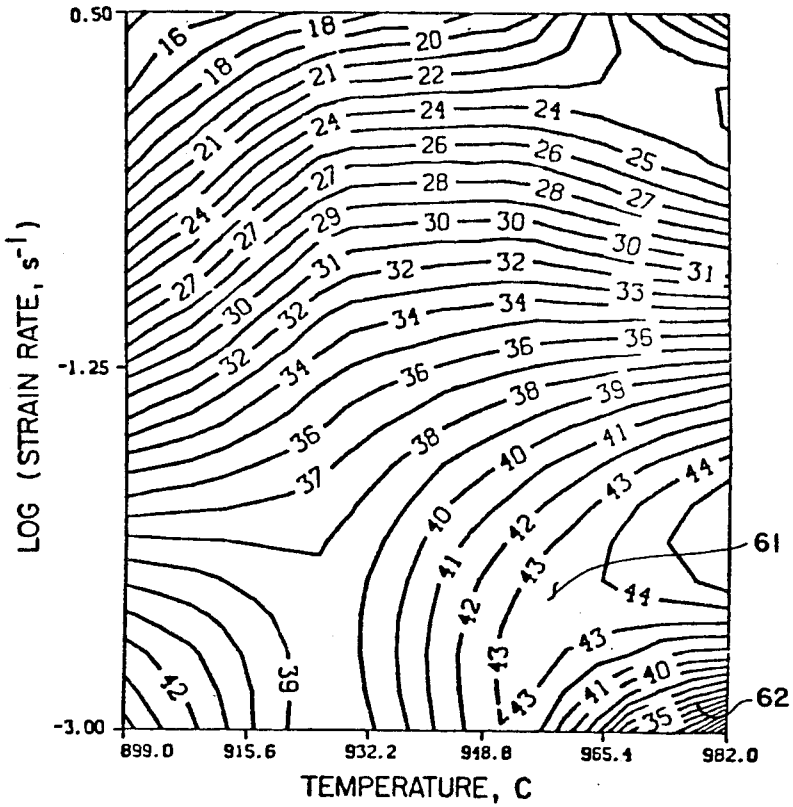
FIG. 6*b* is a contour map, corresponding to FIG. 6*a*, showing constant efficiency contours in the plot of strain rate versus temperature for Ti-6242 $\beta$ preform at 0.04 strain.
Figure 6A:
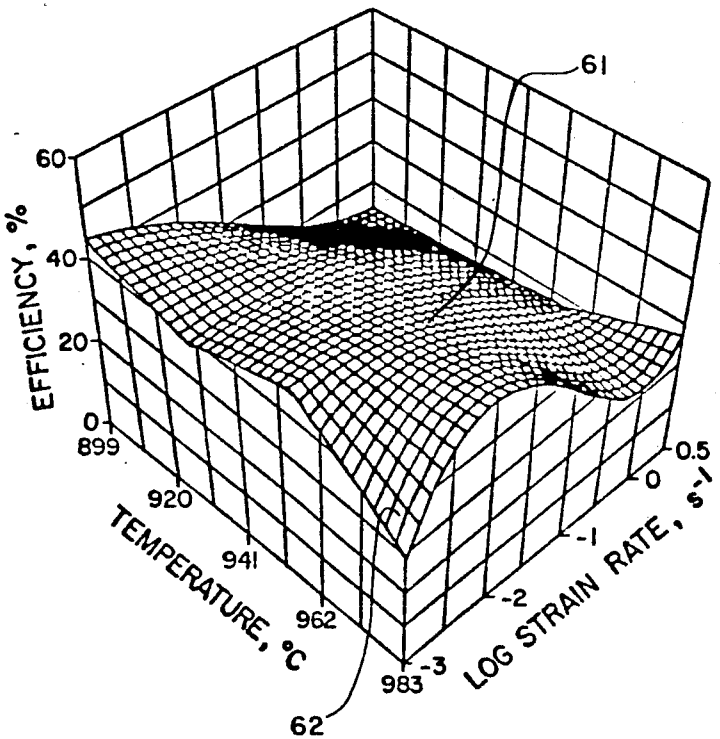
FIG. 6*a* is a three dimensional plot of dissipation efficiency versus temperature and strain rate for Ti-61242 $\beta$ preform at 0.04 strain.
Figure 7A:
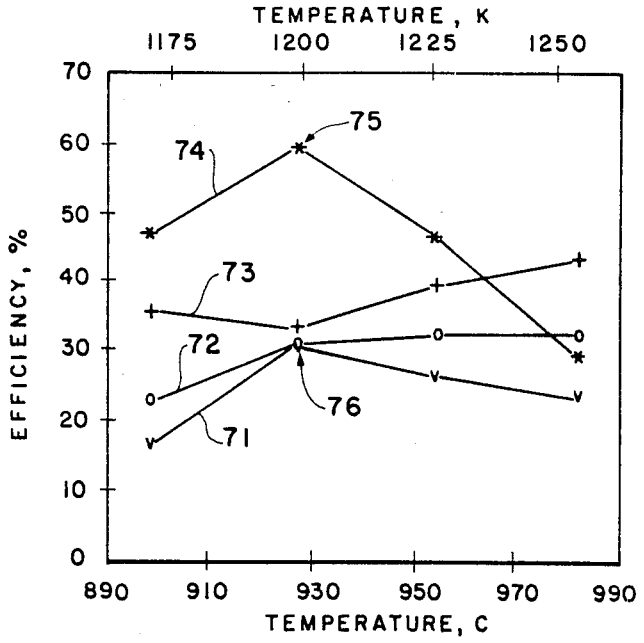
FIG. 7*a* graphs dissipation efficiency versus forging temperature for Ti-6242 $\beta$ preform at 0.6 strain for various strain rates.
Figure 8A:
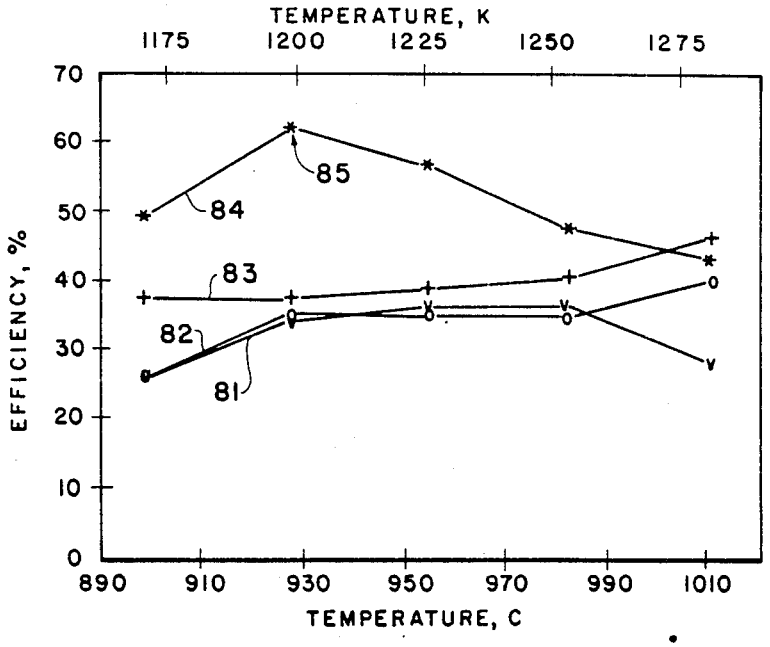
FIG. 8*a* graphs dissipation efficiency versus forging temperature for Ti-6242 ($\alpha+\beta$) preform at 0.6 strain for various strain rates.
Figure 7C:
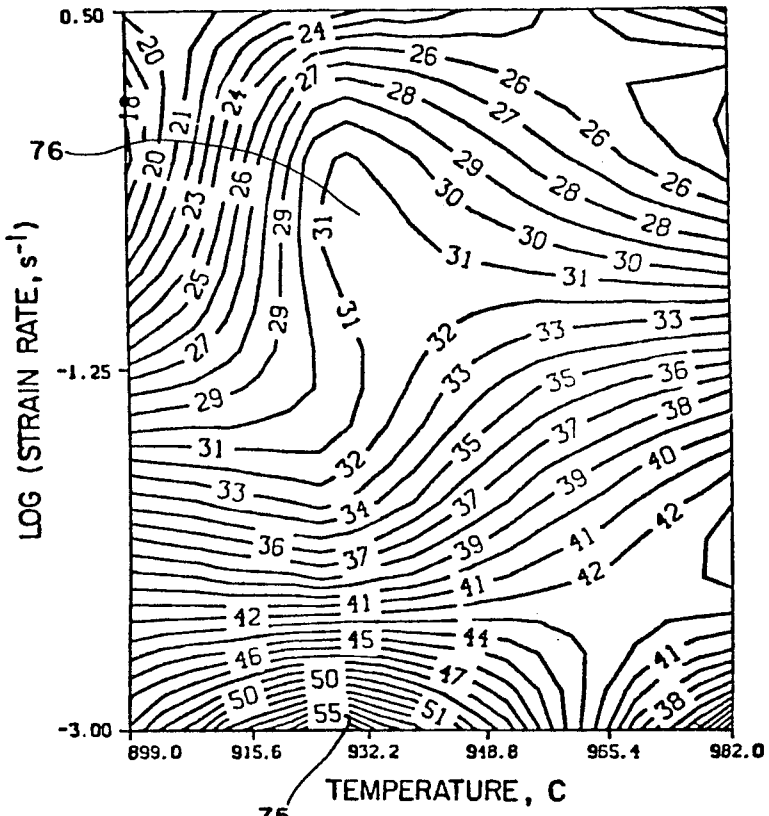
FIG. 7*c* is a contour map, corresponding to FIG. 7*b*, showing constant efficiency contours in the plot of strain rate versus temperature for Ti-6242 $\beta$ preform at 0.6 strain.
Figure 7B:
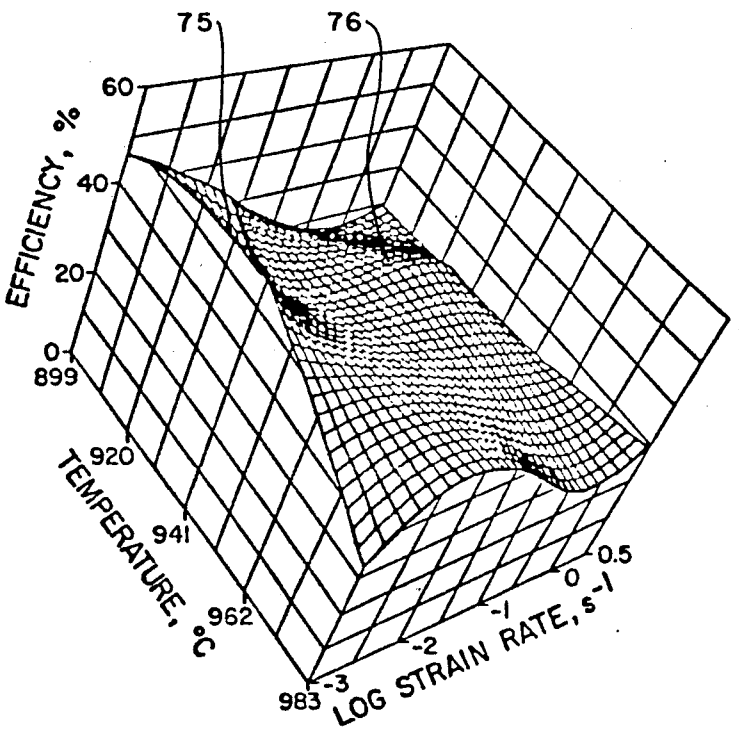
FIG. 7*b* is a three dimensional plot of dissipation efficiency versus temperature and strain rate for Ti-6242 $\beta$ preform at 0.6 strain.
Figure 8C:
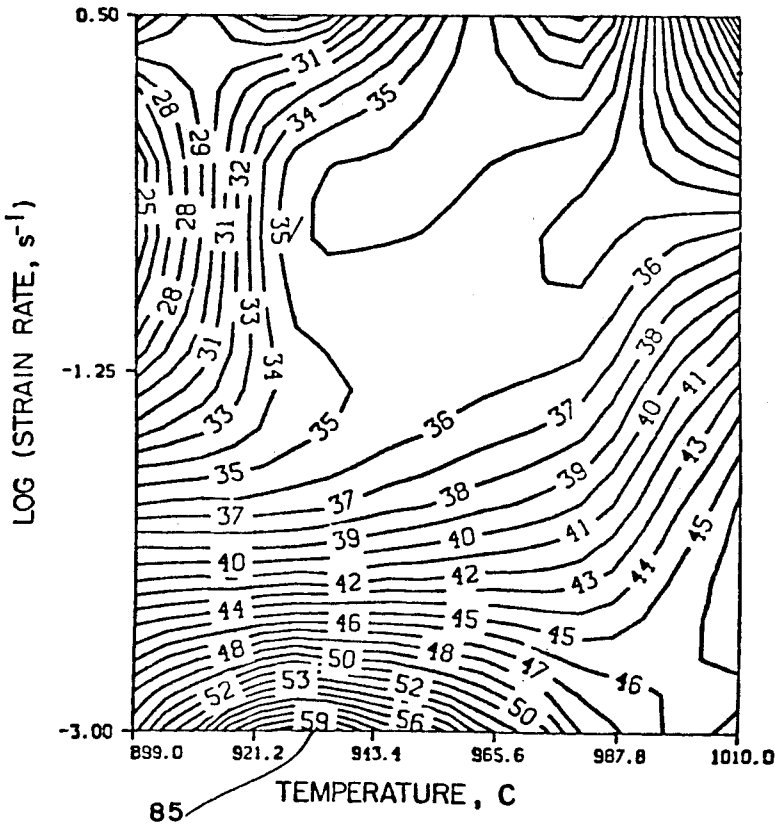
FIG. 8*c* is a contour map, corresponding to FIG. 8*b*, showing constant efficiency contours in the plot of strain rate versus temperature for Ti-6242 ($\alpha+\beta$) preform at 0.6 strain.
Figure 8B:
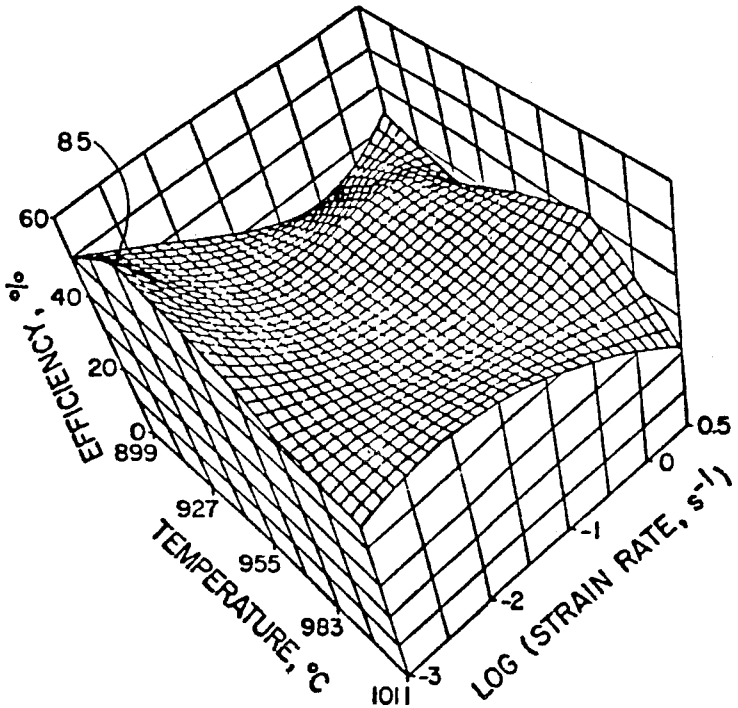
FIG. 8*b* is a three dimensional plot of dissipation efficiency versus temperature and strain rate for Ti-6242 ($\alpha+\beta$) preform at 0.6 strain.
Figure 9B:
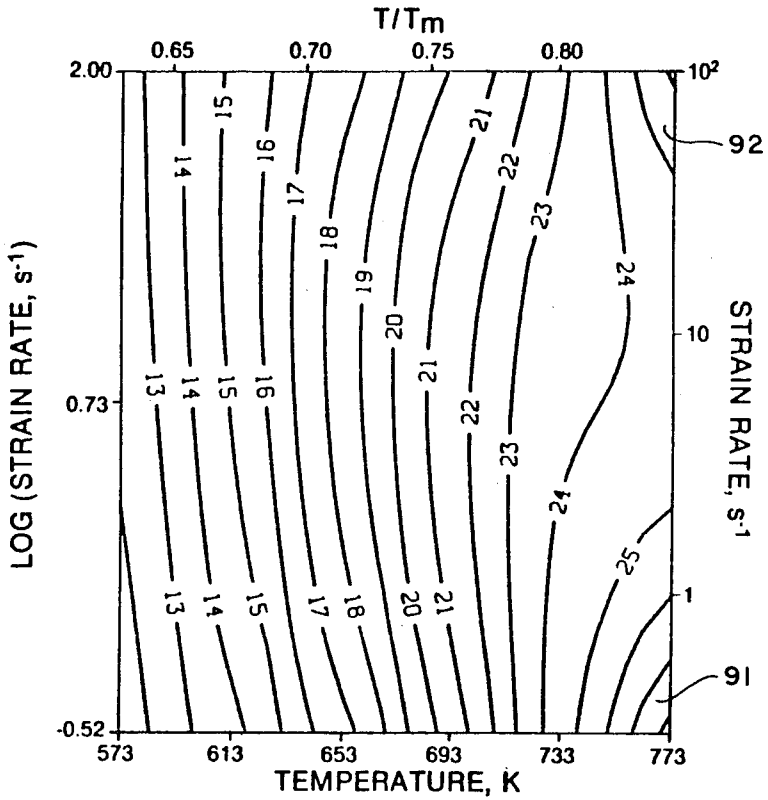
FIG. 9*b* is a contour map, corresponding to FIG. 9*a*, showing constant efficiency contours in the plot of strain rate versus temperature for 2024 aluminum alloy ingot material.
Figure 9A:
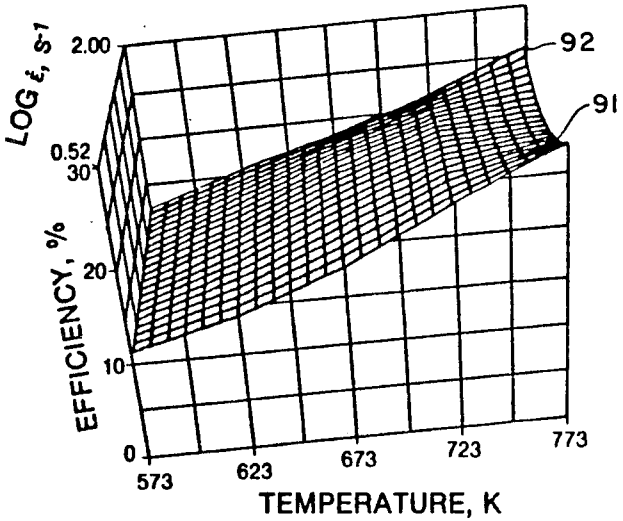
FIG. 9*a* is a three dimensional plot of dissipation efficiency versus temperature and strain rate for 2024 aluminum alloy ingot material.

The variation of flow stress in uniaxial compression of a well lubricated billet, as a function of strain was evaluated at various temperatures in the range 899°–982° C. and at various strain rates in the range 0.001 to 0.1 $s^{-1}$. Similar data was obtained using a cam plastometer at a strain rate of about 1 $s^{-1}$. At each temperature and strain rate, the strain rate sensitivity m (Equation (5)) was evaluated by fitting the polynomial expression to log of flow stress versus log of strain rate curves and obtaining derivatives as described above. The instantaneous power J dissipated by the material (Equation (8)) and the efficiency of dissipation (Equation (10)) were calculated as functions of temperature at each of the strain rates for two strains 0.04 and 0.6. Referring now to FIG. 4, shown therein is the variation of J with temperature for various strain rates in Ti-6242 $\beta$ preform. The solid curves 41,43,45,47, correspond, respectively, to strain rates of 0.001 $s^{-1}$, 0.01 $s^{-1}$, 0.1 $s^{-1}$, and 1.0 $s^{-1}$ at 0.6 strain. Likewise broken curves 42,44,46,48 correspond respectively to those strain rates at 0.04 strain. It is noteworthy that for each set of strain rate data in the temperature range of interest, J is higher for the 0.04 strain, and J is higher for each set of data corresponding to successively higher strain rates. FIG. 5 shows the variation of efficiency of dissipation with temperature of forging for Ti-6242 $\beta$ preform at a strain of 0.04 for various strain rates. Curves 51,52,53,54 correspond respectively to strain rates of 1.0, 0.1, 0.01, and 0.001 $s^{-1}$. FIG. 5 further shows that when the material is deformed at about 0.001 $s^{-1}$, a drop in efficiency of dissipation is evident at temperatures above 954° C. At high strain rates (0.1 and 1 $s^{-1}$), a diffused efficiency peak occurs between 927° C. and about 954° C. At 0.01 $s^{-1}$, however, efficiency of dissipation increases with increase in temperature above 927° C. A three dimensional plot of efficiency versus temperature versus strain rate for Ti-6242 $\beta$ preform at 0.04 strain is shown in FIG. *6a*, and the corresponding contour map is shown in FIG. *6b*. The diffuse efficiency peak, indicated generally at 61, is a region where dynamic recrystallization is dominant. The drop in efficiency of dissipation at 982° C.and 0.001 $s^{-1}$ as indicated generally at 62 is clearly revealed in these maps.

The efficiency variations for Ti-6242 $\beta$ preform at 0.6 strain rate are shown in FIG. *7a*. Curves 71,72,73,74 correspond respectively to strain rates of 1.0, 0.1, 0.01, and 0.001 $s^{-1}$. The corresponding three dimensional plot of variation of efficiency of dissipation with temperature is shown in FIG. *7b*, and the efficiency contour map is shown in FIG. *7c*. FIGS. *7a,7b,7c* show two well defined peaks 75,76 respectively at 927° C. and 0.001 $s^{-1}$ and at 927° C. and 1 $s^{-1}$. The behavior at strain rates of 0.01 and 0.1 $s^{-1}$ remains the same as for low strains. The maps show that optimum forging conditions for $\beta$-preform are 927° C. and 0.001 $s^{-1}$; and if the isothermal forging is performed at high strain rates (about 1 $s^{-1}$) the best temperature would still be 927° C.

Correlation between efficiency variations and metallurgical changes is provided in FIG. *7a*. The microstructures in FIG. *7a* reflect the metastable nature of the $\beta$-preform which shows a tendency toward reaching a more stable microstructural form, the $(\alpha+\beta)$ structure. From the metallographic evidence available, the large drop in efficiency at 0.001 $s^{-1}$ and temperatures beyond 927° C. (to the right of peak 75) is associated with precipitation of transformed $\alpha$ from the metastable $\beta$ structure. At lower strains this precipitation occurs at higher temperatures (greater than about 954° C.). At lower strain rates (less than about 0.01 $s^{-1}$), some grain boundary sliding also occurs, resulting in wedge cracks and grain boundary cavities which aid in energy dissipation. Thus, the two opposing dissipation processes which result in peak 75 are: (1) the precipitation of transformed $\alpha$ (which reduces the rate of energy dissipation), and (2) wedge cracking and grain boundary cavitation (which increase the rate of energy dissipation). At high strain rates (about 1 $s^{-1}$), grain boundary sliding is minimal; while at 0.001 $s^{-1}$ the precipitation of transformed $\alpha$ is more dominant than grain boundary sliding. It is interesting to note that transformed $\alpha$ occurs at wedge cracks and grain boundary cavities and this is a dynamic process in view of the metastable nature of the $\beta$ preform microstructure. At 0.01 $s^{-1}$ wedge cracking dominates at temperatures above 927° C., and hence the efficiency of dissipation increases with increase in temperature. At 899° C., the dissipation processes involved are local kinking of $\beta$ platelets and spheroidization, the former dominating at higher strain rates (about 1 $s^{-1}$) and the latter at lower strain rates (about 0.001 $s^{-1}$).

A disk facsimile of Ti-6242 was produced on the basis of the above information, and comprised a starting material of transformed $\beta$ microstructure which was obtained by $\beta$ forging at 955° C. and $1.5\times10^{-3}$ $s^{-1}$ followed by annealing at 955° C. which results in desired acicular $(\alpha+\beta)$ morphology and prior $\beta$ grain size of approximately 400 microns. The preform geometry was a tapered disk which was isothermally forged at 900° C. and 0.002 $s^{-1}$ (crosshead speed of 1 cm/min) which gave the required gradient in the microstructure. Annealing the forging at 955° C. for 4 hours did not cause an appreciable change in the microstructures. The mechanical properties of the forged product heat treated at 955° C. for four hours and aged at 595° C. for eight hours, measured at room temperature and at 565° C. are shown in Table I. Significant improvement in creep strength and fracture toughness in the outer region (rim) is apparent from data shown in Table I. The forging temperature used in these tests is somewhat below the optimum temperature (927° C.) as determined by examination of FIGS. *7b,7c*. Substantially better mechanical properties would be realized if the forging is done at the optimum temperature.

TABLE I

MECHANICAL PROPERTIES OF Ti-6242 Si DISKS FORGED AT 900° C. AND SOLUTION HEAT TREATED AT 955° C. AND AGED AT 595° C. FOR 8 HOURS, AIR COOLED

| | Center Region | Outer Region |
|---|---|---|
| Room Temperature Tensile Properties | | |
| Yield Strength, MPa | 652 | 636 |
| Ultimate Tensile Strength, MPa | 705 | 668 |
| Elongation, % | 7 | 4 |
| Reduction in Area, % | 15 | 11 |
| 565° C. Tensile Properties | | |
| Yield Strength, MPa | 363 | 353 |
| Ultimate Tensile Strength, MPa | 438 | 436 |
| Elongation, % | 20 | 22 |
| Reduction in Area, % | 49 | 43 |
| Time to 0.1% Creep Strain, hrs at 510° C. and 240 MPa | 188 | 330 |
| Fracture Toughness, MPa $m^{\frac{1}{2}}$ | 52 | 70 |

Similar results were obtained on the equiaxed $(\alpha+\beta)$ preform microstructure of the Ti-6242 titanium alloy. The efficiency of dissipation $\eta$ as a function of temperature and strain rate at a strain of 0.6 for the $(\alpha+\beta)$ microstructure is shown in FIG. *8a*. Curves 81,82,83,844 correspond respectively to strain rates of 1.0, 0.1, 0.01 and 0.001 $s^{-1}$. FIG. *8b* is a three dimensional plot of efficiency versus temperature and strain rate for $(\alpha+\beta)$ Ti-6242 at 0.6 strain, and FIG. *8c* is the corresponding constant efficiency contour map. The strain dependence in this material is not very significant. In the temperature range 899° to 982° C. ($\alpha+\beta$ field), the processing is best performed at 927° C. and 0.001 $s^{-1}$, where the efficiency reaches its peak value, as shown at peak 85. As the strain rate is increased, the efficiency of dissipation decreases and a wider range of temperature exists for processing, the minimum temperature being 927° C. The J variation with temperature (not shown) indicated diffused peaks at 927° C. for strain rates of 0.1 and 1 $s^{-1}$; hence a temperature of 927° C. is preferable for processing even at these strain rates. The metallurgical processes which are responsible for the observed variations may be identified. It is known that the $\beta$ transus for this material is at about 990° C., and near this temperature, power dissipation occurs essentially by the phase transformation $\alpha+\beta$ to $\beta$. Careful microstructural examination of the material deformed at 927° C. and 0.001 $s^{-1}$ revealed recrystallization of the globular $\alpha$ phase in the $\alpha+\beta$ microstructure (near peak 85 of FIG. *8a*). Thus at least two important power dissipation processes occur during hot deformation of $\alpha+\beta$ preforms, viz., dynamic recrystallization and $\alpha+\beta$ to $\beta$ phase transformation. Peak 85 in the efficiency versus temperature curve represents the temperature at which the power of dissipation due to dynamic recrystallization is equal to that due to phase transformation. At 1010° C. the material is deforming as a $\beta$ phase, and the grain size is large (250–300 microns). There was no evidence of dynamic recrystallization. On the other hand, grain boundary sliding occurs at lower strain rates and causes wedge cracking which could, in turn, also dissipate energy with high efficiency. Dissipation by this mechanism is reduced at higher strain rates since grain boundary sliding is less. Metallographic examination of specimens deformed at 1010° C. and low strain rates revealed the transformed $\alpha$ phase in the wedge crack or intergranular crack morphology. This phase occurs because the specimens undergo a non-equilibrium phase transformation when air cooled and the transformed $\alpha$ preferentially forms at sites of high tensile hydrostatic stress.

Figure 13B:
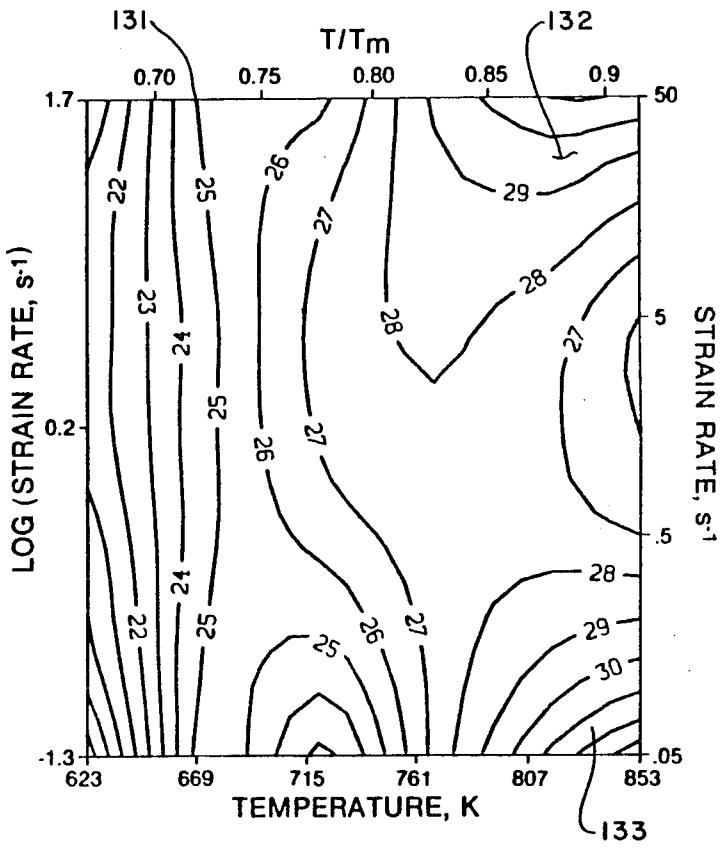
FIG. 13*b* is a contour map, corresponding to FIG. 13*a*, showing constant efficiency contours in the plot of strain rate versus temperature for high purity aluminum metal.
Figure 13A:
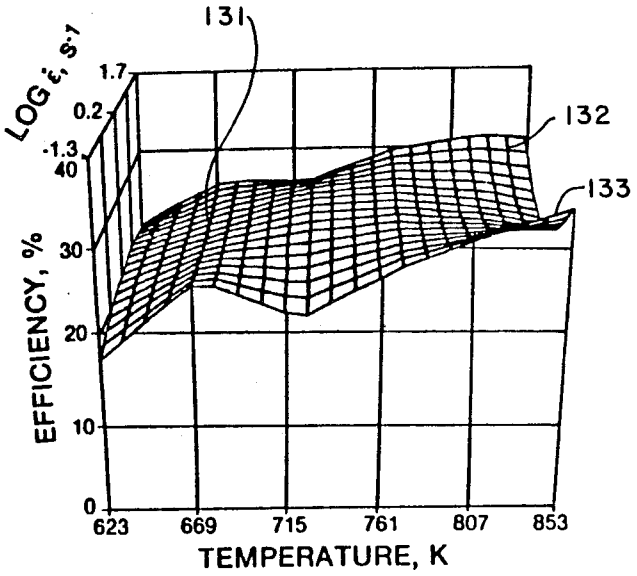
FIG. 13*a* is a three dimensional plot of dissipation efficiency versus temperature and strain rate for high purity aluminum metal.

2024 Aluminum Alloy: A three dimensional processing map for 2024 aluminum alloy (m.p. 775°–911° K.) ingot material is presented in FIG. 9*a*, and the corresponding constant efficiency contour map is presented in FIG. 9*b*. This alloy comprises 4.4 wt% copper, 1.5 wt% magnesium, and 0.6 wt% manganese. Strain rate data from the literature (H. H. Heinemann, *Flow Stress of Different Aluminum and Copper Alloys for High Strain Rates and Temperatures,* PhD Thesis, Technische Hochule, Aachen, West Germany (1961)) were used to generate the processing maps according to the methods of the present invention. The ingot alloy was forged in the temperature range 573° to 773° K. and in the strain rate range 0.3 to 100 $s^{-1}$. Flow stress data at a strain of 0.3 were used to develop map. The map is relatively simple and indicates that the efficiencies of dissipation are low (less than 25%) in most areas, which signifies the occurrence of dynamic recovery in the temperature and strain rate range investigated. The trend of efficiency variation in region 91 near 773° K. and 0.5 $s^{-1}$ is indicative of initiation of wedge cracking which would be intensified by lowering strain rates below 0.5 $s^{-1}$ and increasing temperatures above 773° K. Likewise, the tendency toward increasing efficiency is evident in region 92 near 773° K. and $10^2$ $s^{-1}$, which may eventually lead to dynamic recrystallization at temperatures above 773° K. The map for ingot 2024 aluminum is very similar to that obtained for commercial aluminum (FIGS. 13*a*, 13*b*, infra).

Figure 10B:
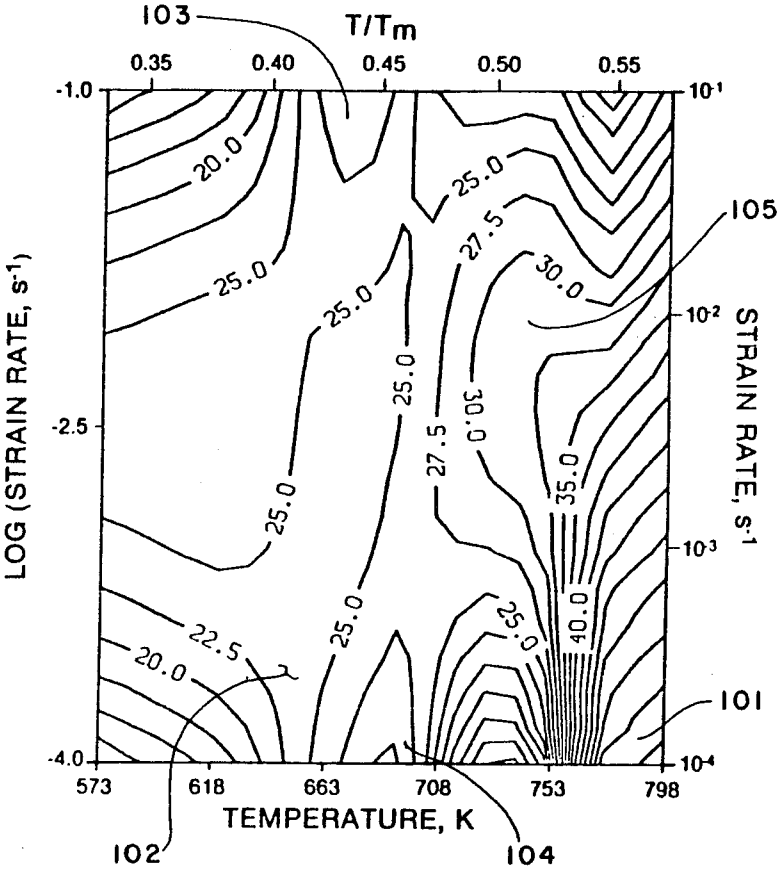
FIG. 10*b* is a contour map, corresponding to FIG. 10*a*, showing constant efficiency contours in the plot of strain rate versus temperature for rapidly solidified powder metallurgy 2024 aluminum alloy.
Figure 10A:
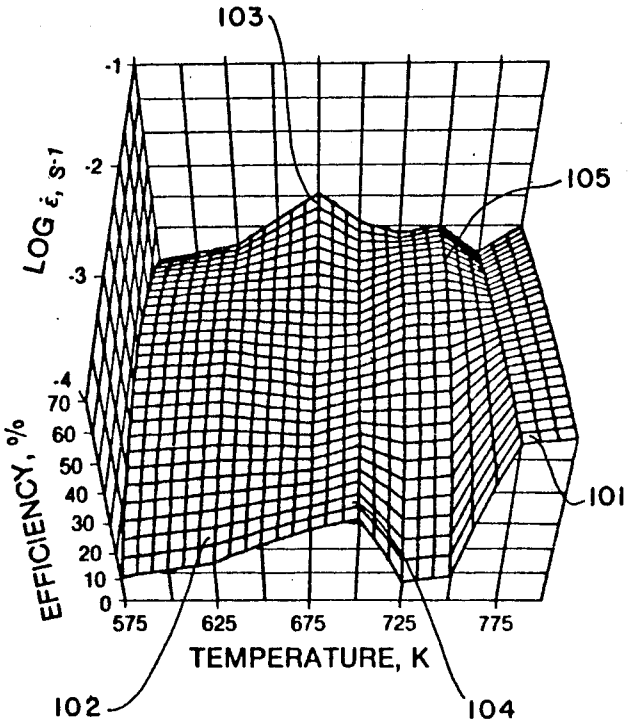
FIG. 10*a* is a three dimensional plot of dissipation efficiency versus temperature and strain rate for rapidly solidified powder metallurgy 2024 aluminum alloy.

The three dimensional processing map and corresponding constant efficiency contour map for rapidly solidified powder metallurgy 2024 aluminum alloy are shown in FIGS. 10*a* and 10*b*, respectively. The flow stress and strain rate data required for FIGS. 10*a*, 10*b* were generated using compression tests in the temperature ranges 573° to 800° K. and strain rate range 0.0001 to 0.1 $s^{-1}$. Details of the testing can be found elsewhere (D. R. Barker, S. M. Doraivelu, H. L. Gegel, and Y.V.R.K. Prasad, in *Proceedings of* 1984 *International Computers in Engineering Conference and Exhibit,* ASME, Las Vegas, NV, 1984, pp 532–536). The rapidly solidified 2024 powder was vacuum hot pressed and extruded, and the extruded specimens were tested in hot compression. The maps of FIGS. 10*a*,10*b* correspond to a strain of 0.3. The variation of efficiency is more complex than that in the ingot 2024 material (FIG. 9*a*) as might be expected on the basis of the metastable microstructure of the powders produced in rapid solidification. The very high efficiency (about 60%) peak 101 observed near 773° K. and a strain rate of $10^{-4}$ $s^{-1}$ is due to wedge cracking, which interpretation was confirmed by examination of the microstructure of the corresponding specimen. Region 102 represented by temperatures less than 673° K. exhibits efficiencies lower than about 25% and represents dynamic recovery. Peaks 103,104,105 corresponding to about 30% efficiency which occur respectively at 673° K. and 0.1 $s^{-1}$, 700° K. and $10^{-4}$ $s^{-1}$, and 723° K. and 0.01 $s^{-1}$, indicate dynamic recrystallization. Microstructure (both optical micrograph and transmission electron micrograph) for material examined at 673° K. and 0.1 $s^{-1}$ showed that a large number of interfaces are created dynamically, and these interfaces result in a fine grained structure in the specimen. The process of dynamic recrystallization has a special significance in powder metallurgy materials since it aids in overcoming defects associated with prior particle boundaries. For billet conditioning powder metallurgy compacts, the process of dynamic recrystallization is highly desirable for enhancing the workability of the material, and the processing maps described above in relation to FIGS. 9*a*–10*b* reveal the unique combination of temperature and strain rate necessary for optimizing this process during billet conditioning.

2024 Aluminum (20 v/o SiC Whiskers): Consider now the metal matrix composite 2024 alumium alloy with 20 volume percent silicon carbide whiskers. The dispersion of whiskers (filamentary single crystals) into a material generally improves its strength and elastic properties. The powder metallurgy 2024 aluminum alloy comprising silicon carbide (SiC) whiskers incorporated into the alloy powder matrix is characterized by a high specific elastic modulus, and is therefore desirable for application as an aerospace structural material. This type of material is difficult to fabricate by metalworking processes, and, since the strength properties are strongly dependent upon the aspect ratio (length-to-diameter ratio) of the incorporated SiC whiskers, it is essential that forming into structural shapes be accomplished without fracturing the whiskers or changing their aspect ratio. One of the most important aspects of this processing is the use of a streamlined die which mitigates the problems caused by internal shearing and rigid body rotations occuring when a shear die is used. The other important aspect of processing this material is the use of optimum temperature and strain rate for extrusion. The technique described in the present invention may be used to obtain the optimum parameters.

Figure 11A:
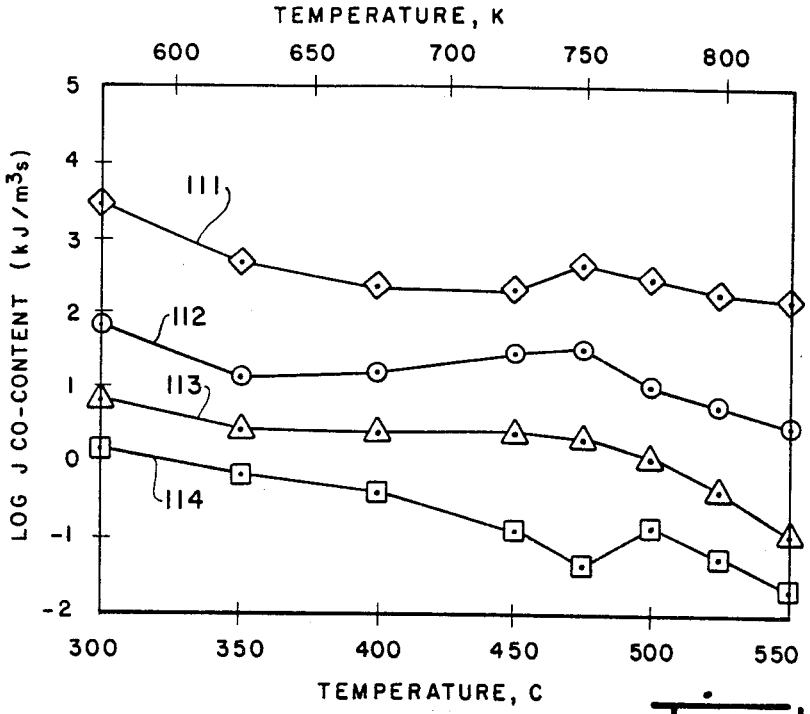
FIG. 11*a* graphs J co-content versus temperature for various strain rates of 2024 aluminum alloy (20 v/o SiC whiskers).
Figure 11B:
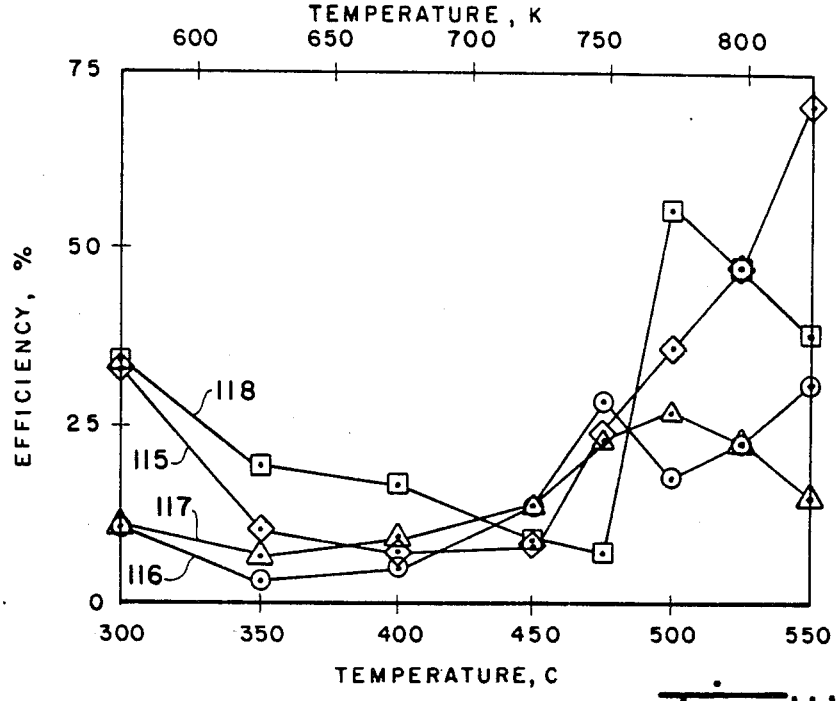
FIG. 11*b* graphs dissipation efficiency versus temperature for various strain rates for 2024 aluminum alloy (20 v/o SiC whiskers).

The strain rate sensitivity parameter and the flow stress data were obtained on this material using uniaxial compression tests at various temperatures in the range 300° to 550° C. and strain rate range 0.1 to 0.001 $s^{-1}$. The calculated values of J and efficiency of dissipation at 0.3 strain as functions of temperature and strain rate were generated therefrom in manner similar to that described above in generation of corresponding plots for Ti-6242 utilizing the expression for J, m and $\eta$ presented supra. FIG. 11*a* shows a plot of J versus temperature, and FIG. 11*b* shows a plot of $\eta$ versus temperature for 2024 aluminum (SiC) material. Curves 111,112,113,114 of FIG. 11*a* correspond respectively to strain rates of 0.1, 0.01, 0.001 and 0.0001 $s^{-1}$. Likewise the curves 115,116,117,118 of FIG. 11*b* correspond to the same respective strain rates. The resulting constant efficiency contour map generated for this material is shown in FIG. 12.

The peaks in J curves 111–114 of FIG. 11*a* and in the efficiency curves 115–118 of FIG. 11*b* represent the temperature at which the dissipated power due to dynamic recrystallization is equal to that due to the second phase particle dissolution. On the left of the peaks, dynamic recrystallization is responsible for greater power dissipation, while on the right of the peaks, second phase particle dissolution dominates.

Referring now to FIG. 11*b*, efficiency curve 115, corresponding to a strain rate of 0.1 $s^{-1}$, beyond 723° K. shows continuous increase with temperature; the peak is not well defined because of the occurrence of matrix kinking following the dynamic recrystallization process. On the other hand, at a low strain rate ($10^{-4}$ $s^{-1}$), ductile fracture initiated by cavity formation occurs at low temperature (300° C.), while cracking at the whisker-matrix interface occurs at higher temperatures (500° C.). At this low strain rate and at high temperature (550° C.) grain growth occurs in the matrix.

Figure 12:
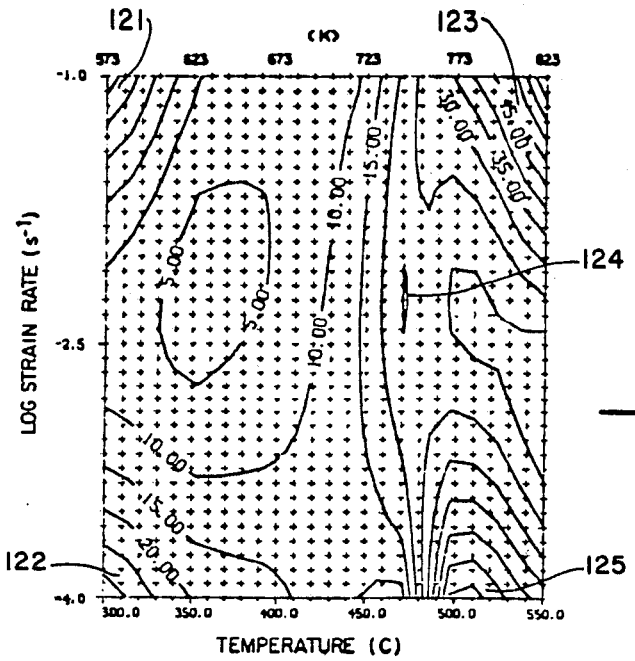
FIG. 12 is a contour map showing constant efficiency contours in the plot of strain rate versus temperature for 2024 aluminum alloy (20 v/o SiC whiskers).

With reference now to FIG. 12, in the lower temperature range (less than 350° C.), the increase in efficiency of dissipation with a decrease in temperature is essentially due to ductile fracture initiation by cavity formation. This is evidenced by the high efficiency regions 121,122 in the lower temperature range at the lower and higher strain rates, respectively. Metallographic examination of the specimen deformed to a strain of 0.5 at 300° C. and 0.1 $s^{-1}$ (region 121) revealed the occurrence of internal fracture by cavitation and whisker fracture and cracking along a few prior particle boundaries. In the temperature range above about 500° C., at region 123 of the map, power dissipation essentially occurs by wedge cracking, a high temperature fracture process which is dependent upon grain boundary or interface sliding. Micrographs of the material showed that at high strain rates (0.1 $s^{-1}$) (region 123) and high temperature (about 550° C.), the power dissipation occurs by kinking of the soft matrix. In the temperature range 350° to 500° C., microstructural observations indicated that region 124 is characterized by the occurrence of dynamic recrystallization in the matrix, and at region 125 dissolution of second phase particles and interface cracking dominates.

FIG. 12 shows that the optimum processing range for the composite occurs over a very narrow range 124 of temperature (around 475° C.) and strain rate (0.01 $s^{-1}$) in which dynamic recrystallization is the dominant mechanism. The tensile properties of a billet of this composite extruded using the predicted parameters and a streamlined die matched well with theoretically calculated values.

Aluminum: Consider now the system comprising high purity aluminum (m.p. 933° K.). The three dimensional efficiency map and the corresponding constant efficiency contour map for aluminum are shown in FIGS. 13*a* and 13*b*, respectively. The data used to generate FIGS. 13*a*,13*b* are based on hot deformation information derived from the literature and cover a wide range of temperatures, strain rates, metallic purity, test procedures, etc., e.g., the data used in part was derived from Akeret (Z Metallk 61, 3(1970)) and cover a wide range of temperatures (623°–853° K.) and strain rate (0.05 to 50 $s^{-1}$) on 99.5% aluminum using the hot torsion technique; flow stress values used in this analysis correspond to a strain of 5.0, and the temperatures reported have not been corrected for adiabatic temperature rise during the test. Peak 131 with an efficiency of about 25% occurs near 670° K. and is nearly strain rate independent. Region 132 at the high temperature, high strain rate corners of FIGS. 13*a*,13*b* correspond to a dynamic recrystallization mechanism, and has about 30% efficiency. In the low strain rate, high temperature region 133, a tendency toward increasing efficiency with decreasing strain rate is observed, and this region is characterized by wedge cracking.

Figure 14B:
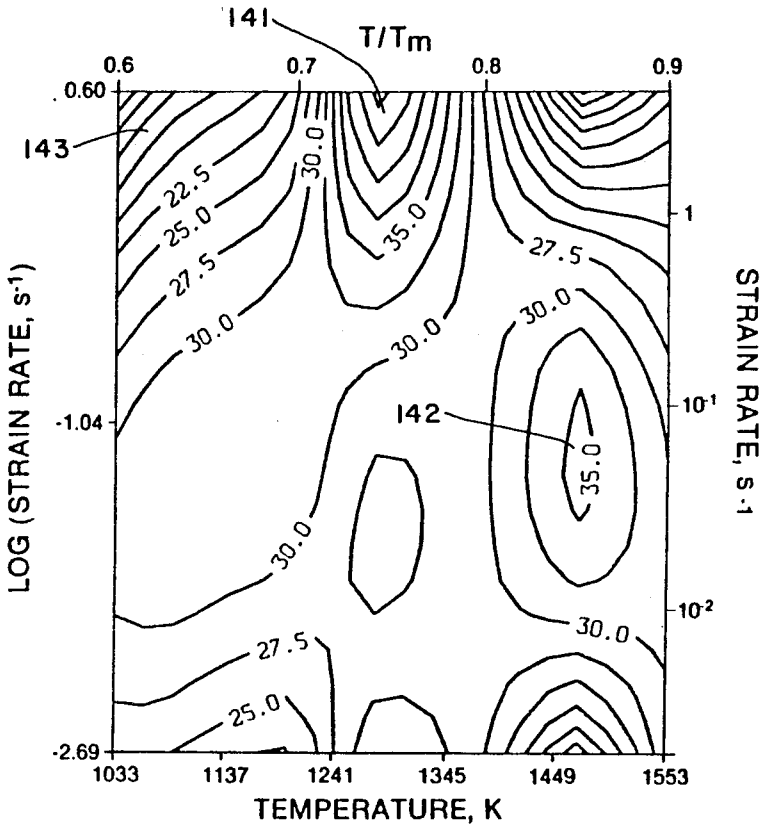
FIG. 14*b* is a contour map, corresponding to FIG. 14*a*, showing constant efficiency contours in the plot of strain rate versus temperature for high purity nickel.
Figure 14A:
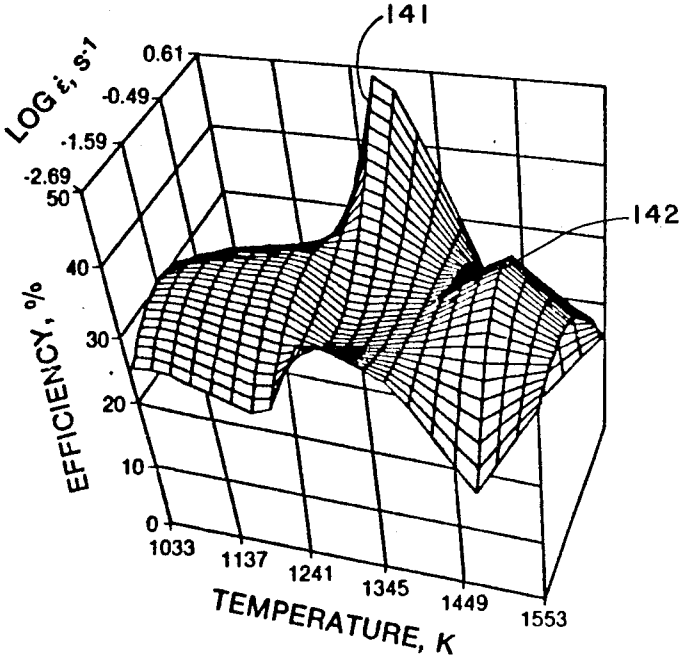
FIG. 14*a* is a three dimensional plot of dissipation efficiency versus temperature and strain rate for high purity nickel.

Nickel: A processing map for substantially pure nickel (m.p. 1726° K.) is presented as a three dimensional plot in FIG. 14*a*, and as a constant efficiency contour map in FIG. 14*b*. FIGS. 14*a*, 14*b* were generated using the hot deformation data reported by in the literature (M. J. Luton and C. M. Sellars. Acta Metall 17, 1033 (1969)), and obtained using hot torsion tests in the temperature range 1033° to 1553° K. and strain rate range of about 0.002 to 4 $s^{-1}$. The temperatures used in FIGS. 14*a*,14*b* were not corrected for the adiabatic temperature rise which is important at high strain rates. A very strong peak 141 (about 45% efficiency of dissipation) is evident at 1270° K. and 4 $s^{-1}$. At intermediate strain rates (0.02 to 0.2 $s^{-1}$), a peak 142 with approximately 35% efficiency of dissipation appears at 1475° K. Efficiencies of dissipation are relatively low in the low strain rate range (about 0.002 $s^{-1}$) throughout the temperature range displayed. Peaks 141,142 are characterized by dynamic recrystallization, although, as demonstrated in FIGS. 14*a*,14*b*, this process occurs most efficiently at 1270° K. and 4 $s^{-1}$. Regions with efficiencies lower than about 30% correspond to processes of dynamic recovery (e.g., region 143 near 1033° K. and 4 $s^{-1}$). FIGS. 14*a*,14*b* do not suggest the occurrence of wedge cracking in the strain rate range studied.

Figure 15B:
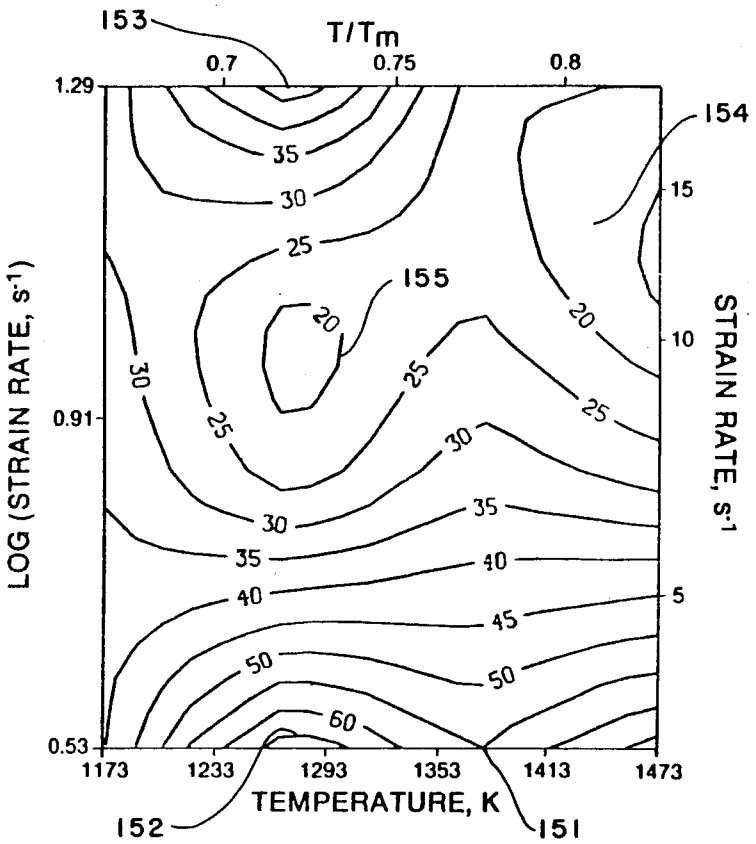
FIG. 15*b* is a contour map, corresponding to FIG. 15*a*, showing constant efficiency contours in the plot of strain rate versus temperature for electrolytic cobalt.
Figure 15A:
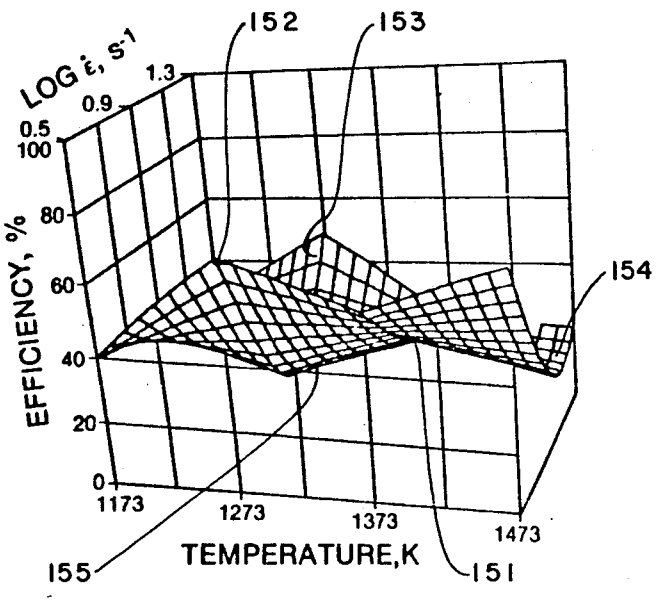
FIG. 15*a* is a three dimensional plot of dissipation efficiency versus temperature and strain rate for electrolytic cobalt.

Cobalt: A processing map for electrolytic cobalt (m.p. 1768 K.) is presented as a three dimensional plot in FIG. 15*a*. and as a constant efficiency contour map in FIG. 15*b*. In generating the processing map for cobalt according to the method of the present invention, data from the literature on the flow behavior of electrolytic cobalt (99.98%) in the temperature range 1173°–1473° K. and strain rate range 3.4–19.9 $s^{-1}$ at 0.51 strain were used (J. M. Jacquerie and L. Habraken, Cobalt 38, 13 (1968)). The testing technique employed was compression using a cam plastometer. No correction for adiabatic temperature rise was incorporated. For the test temperature range displayed, cobalt has an fcc structure and exhibits a magnetic transformation at about 1388° K. The map reveals a bifurcation 151 at this temperature which is nearly independent of strain rate. The peak 152 near 1273° K. and 3.4 $s^{-1}$ has an efficiency of about 65% and is attributed to dynamic recrystallization. At about the same temperature but very high strain rates (19.9 $s^{-1}$), another peak 153 is apparent which has an efficiency of about 45% and is attributed to adiabatic shearing. The maps of FIGS. 15*a*,15*b* predict grain growth with increasing strain rate, since efficiency decreases with increasing strain rates at 1473° K. in region 154. Bifurcation 155 between dynamic recrystallization and adiabatic shearing process domains occurs around 1273° K. and at a strain rate of about 9.8 $s^{-1}$.

Copper: A processing map of OFHC copper (m.p. 1356° K.) is presented in three dimensional form in FIG. 16*a* and as a constant efficiency contour map in FIG. 16*b*. Data from the literature on high temperature deformation of OFHC copper using hot torsion tests over a temperature range of 810° to 1230° K. and a strain rate range of about $4.5\times10^{-4}$ to 6.8 $s^{-1}$ were used to generate the map (R. Bromley, *The High Temperature Deformation of Copper and Copper-Aluminum Alloys*, PhD Thesis, Univ of Sheffield, England (1969)). No correction for adiabatic heating was incorporated.

Figure 16B:
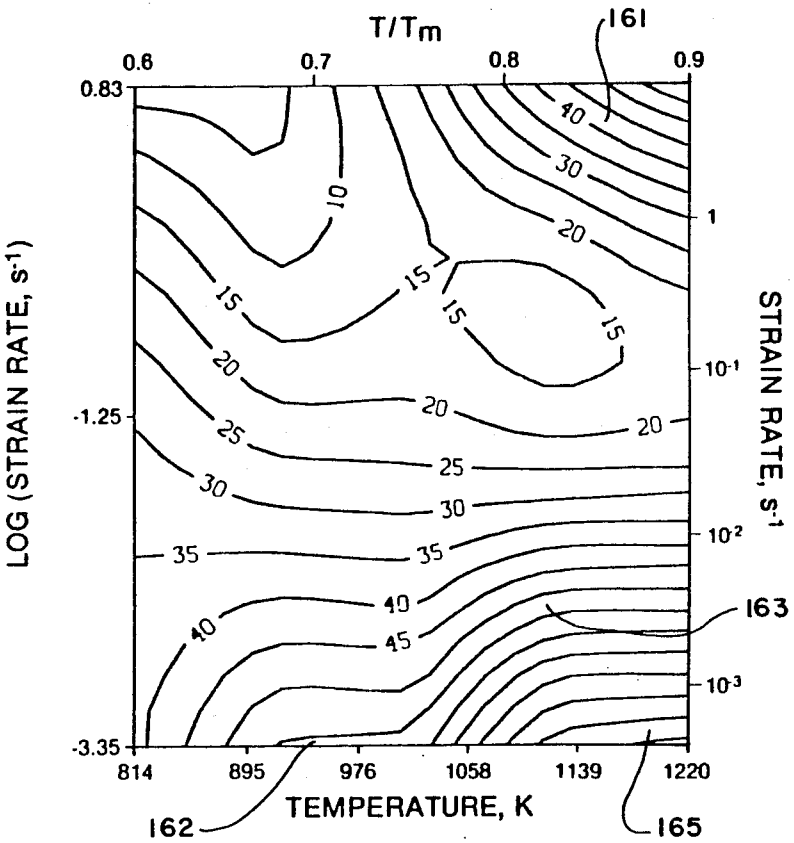
FIG. 16*b* is a contour map, corresponding to FIG. 16*a*, showing constant efficiency contours in the plot of strain rate versus temperature for OFHC copper.
Figure 16A:
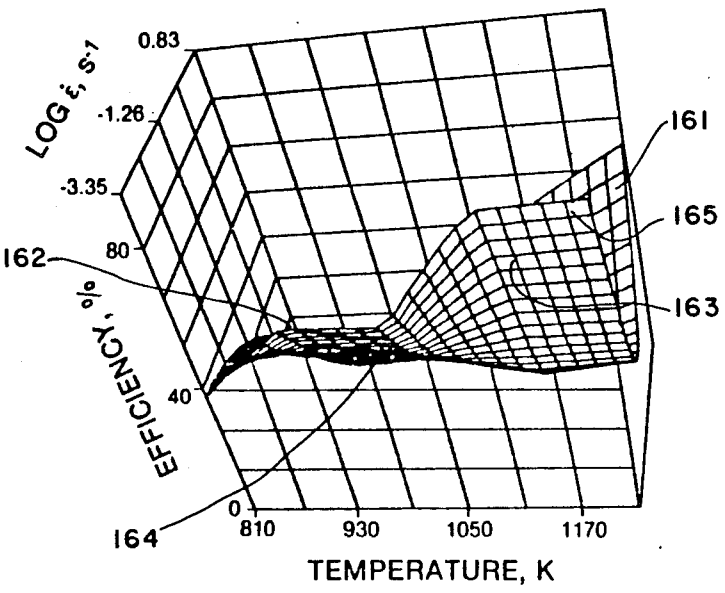
FIG. 16*a* is a three dimensional plot of dissipation efficiency versus temperature and strain rate for OFHC copper.

FIGS. 16*a*, 16*b* show in region 161 that at high temperatures (about 1100° K.) and high strain rates (greater than 1 $s^{-1}$), the efficiency is high, being about 55% at 1230 K. and 0.83 $s^{-1}$. The trend toward efficiency variation in this region is typical of flow instabilities. Efficiencies of the order of 55% are also observed in region 162 at lower temperatures (810° to 1010° K.) and lower strain rates (0.00045 to 0.005 $s^{-1}$), and over a wide temperature range (810° to 1230° K.) for the intermediate strain rates (0.005 to 0.05 $s^{-1}$) in region 163. Regions 162,163 correspond to dynamic recrystallization processes, although the latter range 163 is in the vicinity of bifurcation 164. In region 165, the high temperature (greater than 1050° K.), low strain rate (less than 0.005 $s^{-1}$) area of the map, efficiency of dissipation is very high (about 85%) and increases with decreasing strain rate and corresponds to wedge cracking in the microstructure.

Figure 17B:
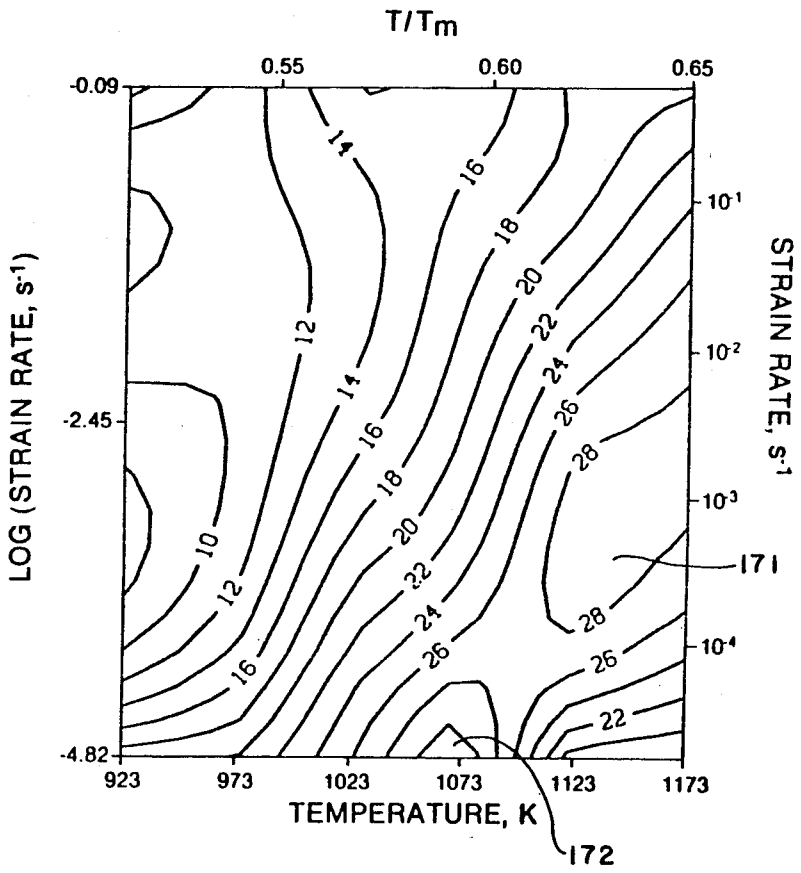
FIG. 17*b* is a contour map, corresponding to FIG. 17*a*, showing constant efficiency contours in the plot of strain rate versus temperature for α-iron.
Figure 17A:
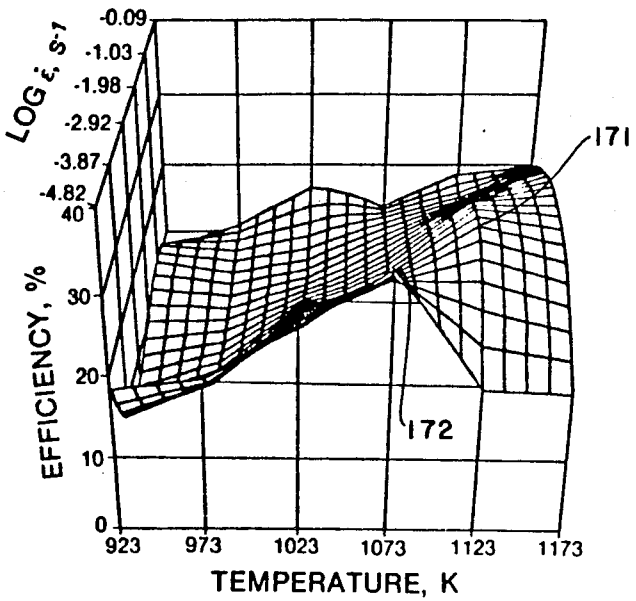
FIG. 17*a* is a three dimensional plot of dissipation efficiency versus temperature and strain rate for α-iron.

Armco Iron: A processing map of the invention for pure $\alpha$-iron (m.p. 1807° K.) is shown as a three dimensional plot in FIG. 17*a*, and as a constant efficiency contour map in FIG. 17*b*. The data used in generating the map were derived from the literature on hot compression tests in the temperature range 923°-1173° K. and strain rate range $1.5\times10^{-5}$ to 0.8 $s^{-1}$ (J-P. A. Immarigeon and J. J. Jonas, Acta Metall 22, 1235 (1974)). The map defined in FIGS. 17*a*, 17*b* is based on yield stress data since these are the only values which have been reported over the complete range of test parameters of interest in generating the processing map. The efficiency of power dissipation is low, viz., less than about 33% throughout the map. Peak 171 with an efficiency of about 30% occurs around 1123° K. when the strain rate is in the range 0.0001 to 0.001 $s^{-1}$, and peak 172 with similar efficiency of dissipation occurs at 1073° K. and about $10^{-5}$ $s^{-1}$. Most of the area in this processing map is characterized by dynamic recovery in the microstructure. Peaks 171,172 correspond to dynamic recrystallization and wedge cracking, the competing process at high temperatures being dynamic grain growth.

Figure 18B:
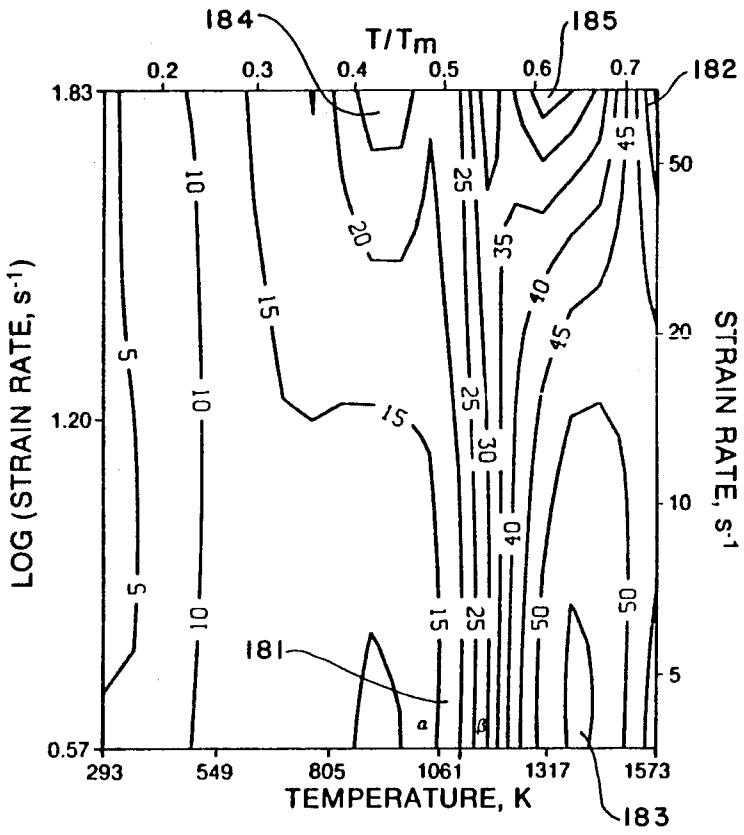
FIG. 18*b* is a contour map, corresponding to FIG. 18*a*, showing constant efficiency contours in the plot of strain rate versus temperature for high purity zirconium.
Figure 18A:
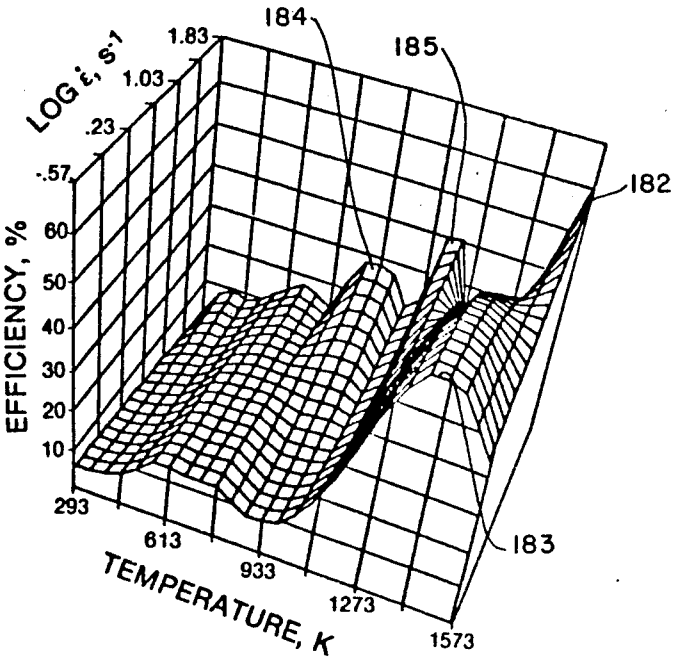
FIG. 18*a* is a three dimensional plot of dissipation efficiency versus temperature and strain rate for high purity zirconium.

Zirconium: A processing map for zirconium (m.p. 2125° K.) is shown as a three dimensional plot in FIG. 18*a*, and as a constant efficiency contour map in FIG. 18*b*. The map was generated using data from the literature on 99.8% pure material tested in compression over a temperature range from 293° to 1573° K. and strain rates from 0.25 to 67.6 $s^{-1}$ at 0.2 strain. (H. Buhler and H. W. Wagener, Z Metallk 58, 136 (1967)). The $\alpha$-$\beta$ transistion temperature is about 1135° K.; however, this transition appears on the map at 181 at lower temperatures since the adiabatic temperature rise makes a contribution. The $\alpha$-$\beta$ transition appears as a drop in efficiency of dissipation occurring at about 1000°-1050° K. This drop is expected from thermodynamic considerations since a free energy minimum which occurs at the transition gives rise to a point of singularity. The excess entropy change with time therefore tends to zero. Another area of interest in this map is the high temperature, high strain rate region 182 near 1573° K. and 67 $s^{-1}$. In region 182 efficiency increases abnormally with increase in temperature and strain rate, which is typical of instability. At about 1400° K. and strain rate of about 0.5 $s^{-1}$, efficiency peak 183 (approximately 55%) indicates the tendency of $\beta$-Zr toward wedge cracking. Peaks 184,185 at 933° K. and 67 $s^{-1}$ and 1200° K. and 67 $s^{-1}$ correspond to dynamic recrystallization of $\alpha$-Zr and $\beta$-Zr, respectively. Efficiencies at peaks 184,185 are typically about 30%. The lower temperature region (less than 900° K.) of the map has lower efficiencies (less than 20%) and is characterized by dynamic recovery in the microstructure.

Figure 19B:
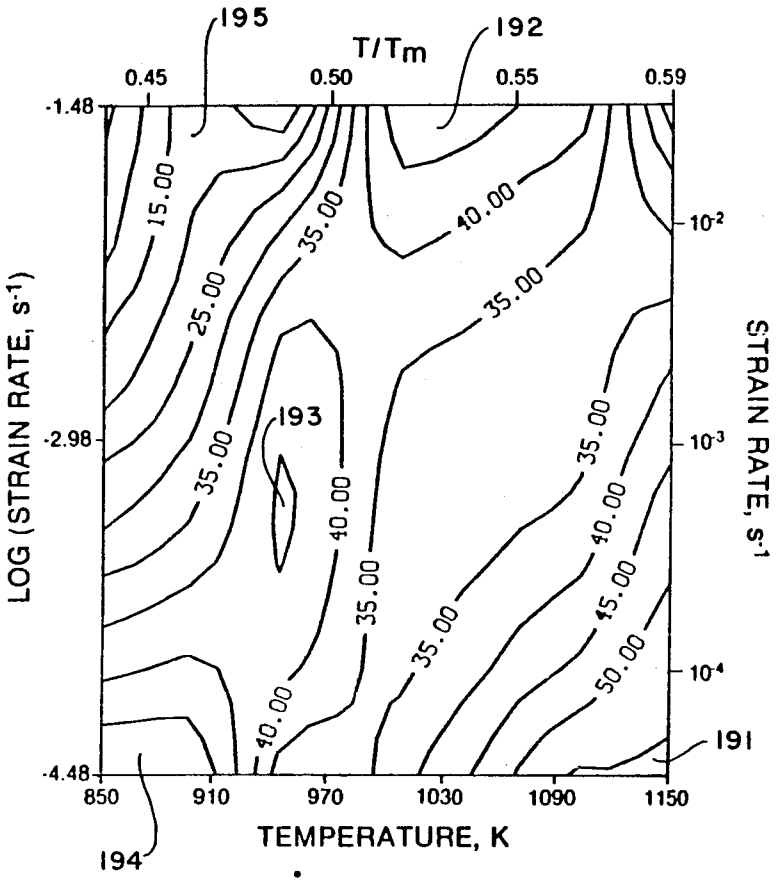
FIG. 19*b* is a contour map, corresponding to FIG. 19*a*, showing constant efficiency contours in the plot of strain rate versus temperature for commercial titanium.
Figure 19A:
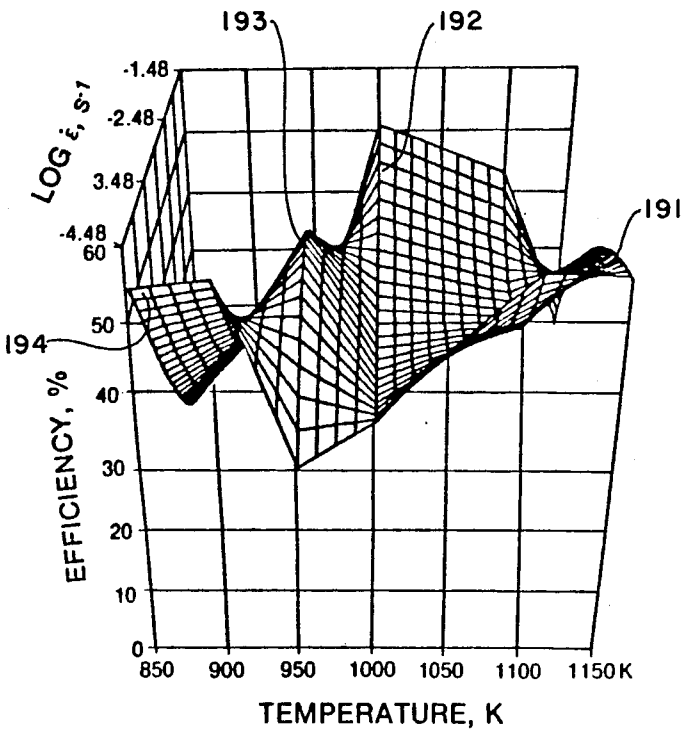
FIG. 19*a* is a three dimensional plot of dissipation efficiency versus temperature and strain rate for commercial titanium.

Titanium: A processing map for commercial titanium (Ti-50A) (m.p. 1941° K.) was generated as a three dimensional plot as shown in FIG. 19*a*, and as a constant efficiency contour map as shown in FIG. 19*b*. Data from the literature obtained by tensile testing in the temperature range 850° to 1150° K. and strain rate range $3.3\times10^{-5}$ to $3.3\times10^{2}$ $s^{-1}$ were used to generated the map (M. Doner and H. Conrad, Metall Trans 4A, 2809 (1973)). In the temperature range 600° to 800° K., the efficiency is very low (less than 10%) and nearly zero at strain rates in the range $10^{-4}$ to $10^{-5}$ $s^{-1}$, characterized by dynamic strain aging in this temperature range. When dynamic strain aging occurs, the material acts as a power store rather than as a dissipator. The high efficiency of dissipation in region 191 near 1100° K. and $3.3\times10^{-5}$ $s^{-1}$ strain rate corresponds to wedge cracking, and this is reflected in reduced ductilities observed in this material. Peak 192 near 1000° K. and $3.3\times10^{-2}$ $s^{-1}$, peak 193 near 950° K. and $5\times10^{-4}$ $s^{-1}$, and peak 194 near 900° K. and $3.3\times10^{-5}$ $s^{-1}$ corresponds to efficiencies in the range 45-55% characterized by dynamic recrystallization in the material. The lower temperature (less than 900° K.), higher strain rate (greater than $10^{-4}$ $s^{-1}$) region 195 is the dynamic recovery region and has efficiencies less than 25%.

Figure 20:
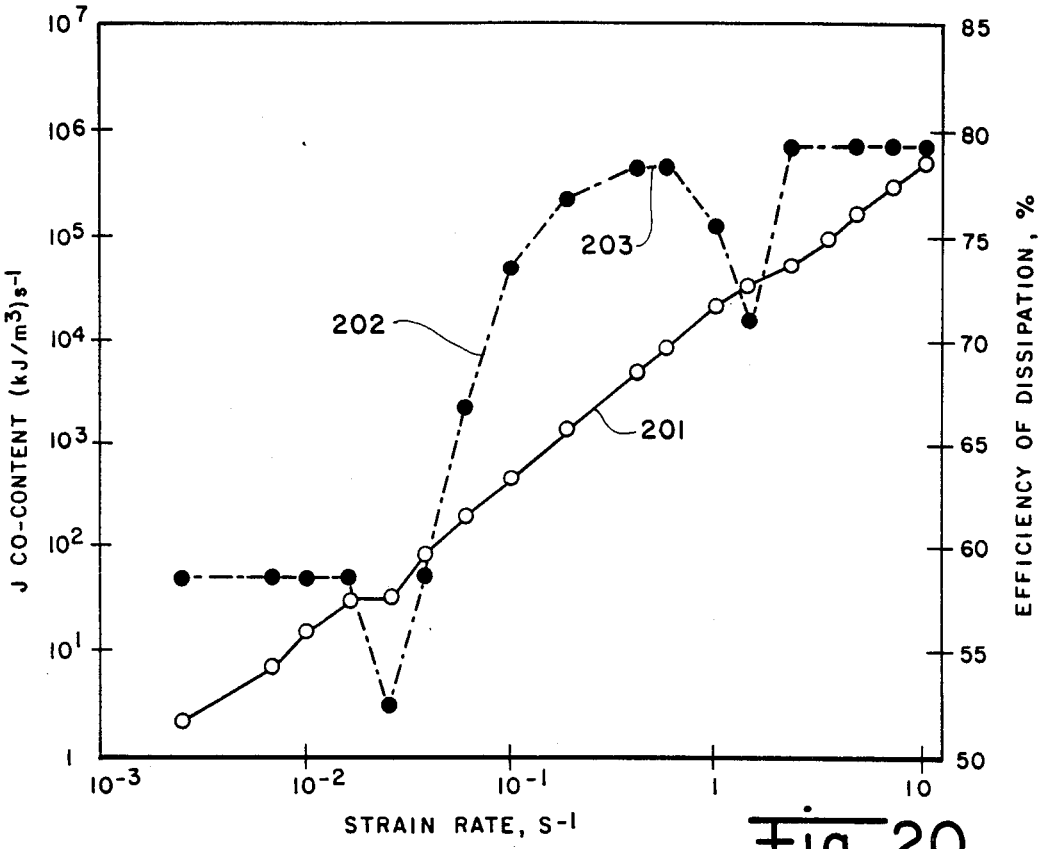
FIG. 20 graphs J co-content and dissipation efficiency versus strain rate at 1080° C. for IN-100 powder metallurgy alloy.

Superalloy Systems: The principles of the invention may be extended to substantially any metal, alloy or other material behaving as a flowing solid under stress including, e.g., the nickel based superalloy powder metallurgy materials IN-100 (m.p. approx 1523°-1573° K.) and Rene-95 (m.p. approx 1523°-1573° K.) and titanium aluminide (m.p. approx 1853° K.). The nominal composition of IN-100 is 5 wt% aluminum, 4.3 wt% titanium, 12 wt% chromium, 18 wt% cobalt, 3.2 wt% molybdenum, 0.8 wt% vanadium, 0.06 wt% zirconium, 0.07 wt% carbon, 0.02 wt% boron, with the balance being nickel. A two dimensional efficiency map for a sample of IN-100 powder metallury material extruded at 1080° C., is shown in FIG. 20. Graph 201 plots J co-content versus strain rate and graph 202 plots efficiency of dissipation versus strain rate. Graph 202 shows peak 203 representing an optimum strain rate at 1080° C. at 0.5 $s^{-1}$ at which the efficiency of dissipation is about 78%. Dynamic recrystallization of the material occurs at this processing range.

Figure 21:
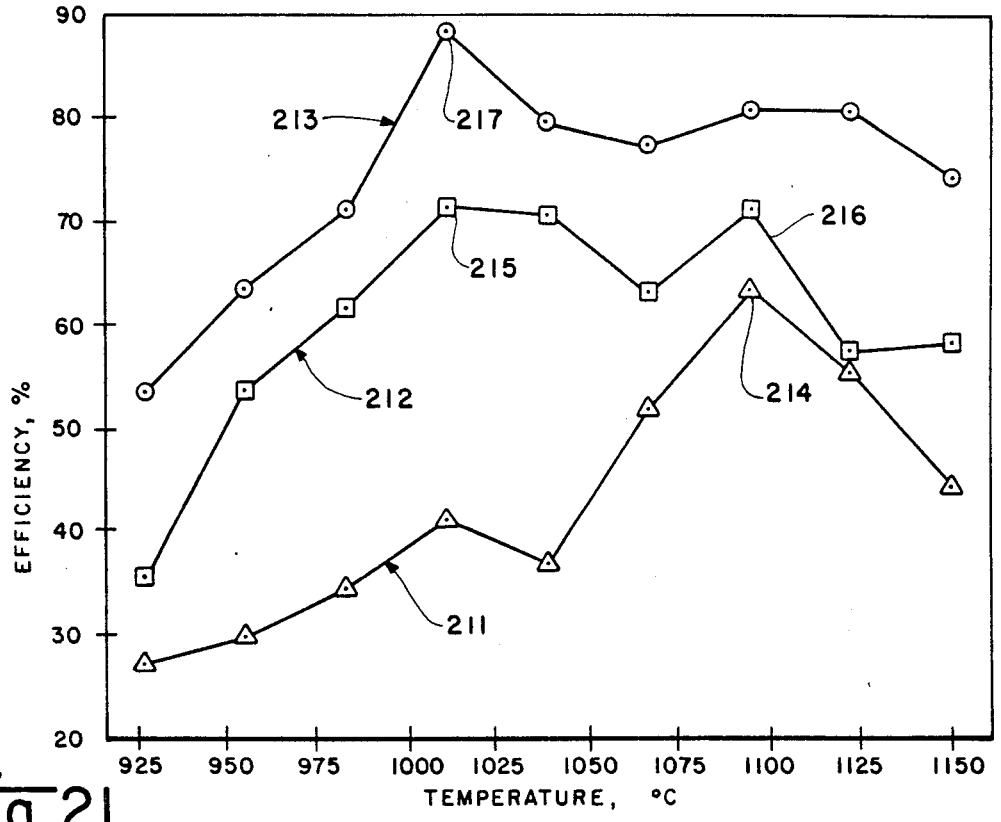
FIG. 21 graphs dissipation efficiency versus temperature for RENE-95 in three different billet conditions.

Graphs of efficiency versus temperature for Rene-95 (nominal composition 14 wt% chromium, 8 wt% cobalt, 3.5 wt% molybdenum, 3.5 wt% tungsten, 3.5 wt% tantalum, 3.5 wt% aluminum, with the balance being nickel) are shown in FIG. 21 for three initial billet conditions. Graph 211 represents hot isostatically pressed material, graph 212 represents extruded material, and graph 213 represents hot isostatically pressed and then extruded material, all at a strain rate of about $1.1\times10^{-2}$ $s^{-1}$. At that strain rate, graph 211 indicates that the optimum temperature for processing of hot isostatically pressed material is 1093° C. near peak 214; for extruded material the optimum temperature is 1010° C. for 1093° C. near peaks 215,216, respectively; for hot isostatically pressed plus extruded material the optimum temperature is 1010° C. near peak 217. In order to substantiate these data, Rene-95 powder of two different mesh sizes (−150 and −60) were consolidated by hot compaction and extruded through steamlined dies. The extrusion ratios were 7.39:1 and 4.7:1. Based on the data revealed by FIG. 21, a compaction temperature of 1093° C. was selected, and the extrusion temperature was 1010° C., at a ram speed of 1.2 inch/sec resulting in a strain rate of about 0.4 $s^{-1}$. The extrusions were produced successfully and the product was found to have excellent mechanical properties and fine grained microstructure.

Figure 22:
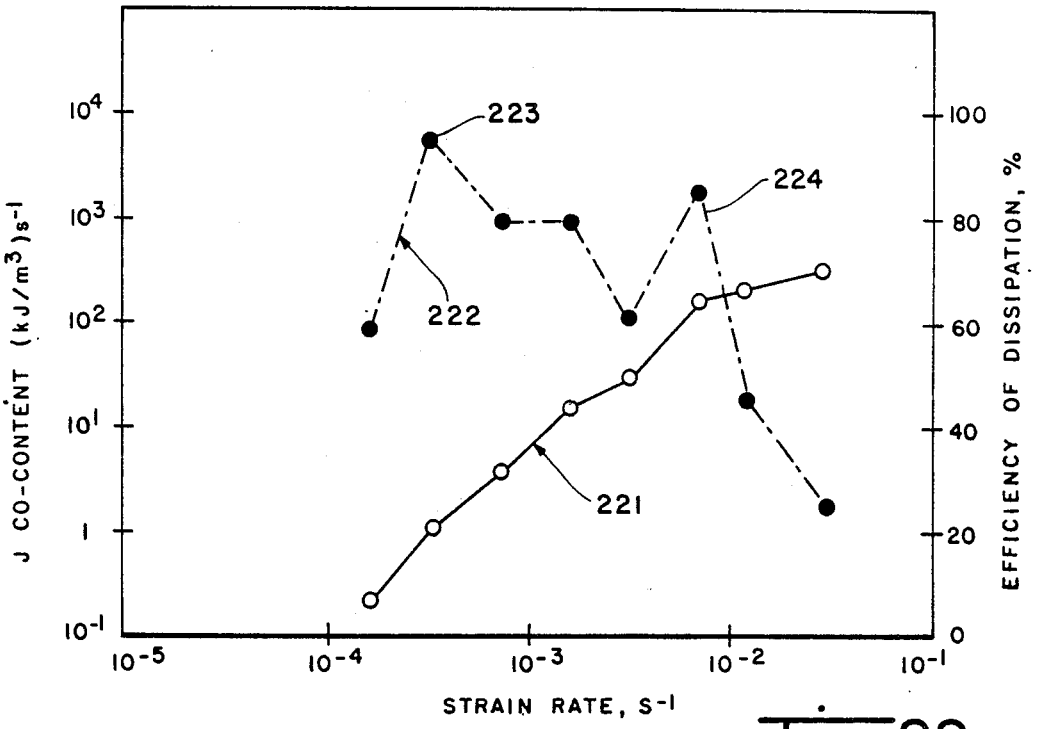
FIG. 22 shows plots of J co-content and dissipation efficiency versus strain rate of 982° C. for titanium aluminide.

The processing conditions for forming titanium aluminide sheet material ($Ti_3Al\alpha_3$-transverse) are shown in the plot of J co-content and efficiency of dissipation versus strain rate at 982° C. as presented in FIG. 22. J co-content as a function of strain rate is given by graph 221, and corresponding dissipation efficiency is given in graph 222, at a temperature of 982° C. (O'Connell and Berczik, FR-13378, AFSC-ASD-WPAFB (1980)). The material deforms superplastically at 982° C. and $4\times10^{-4}\,s^{-1}$ strain rate resulting in peak 223. At 982° C. and $7\times10^{-3}\,s^{-1}$, the material exhibits dynamic recrystallization as shown by peak 224. The efficiency of dissipation for superplasticity is 95% and that for the dynamic recrystallization is 85%. The implication of these results is that the time for producing a unit strain for superplasticity is about 40 minutes while that for dynamic recrystallization is about 2 minutes. Both these processes dissipate power in this material at high efficiency although dynamic recrystallization gives fine grained microstructures as against grain boundary sliding and grain rotations in superplasticity.

SUMMARY

On the basis of the dynamic model discussed, the constitutive behavior of a material may be explicitLy described in terms of the efficiency of power dissipation. In each of the representative examples discussed it is shown that each metallurgical process has a characteristic efficiency of dissipation, depending on the processing and heat treat histories of the material, in the corresponding temperature and strain rate ranges as defined in the processing map generated according to the present invention.

The processing maps developed according to the invention are sensitive to the chemistry and starting microstructure of the material since these factors influence power dissipation processes. In addition, homogeneity of deformation of the material may be achieved by using a well lubricated billet and by confining the testing to intermediate values of strain. In metal forming processes the homogeneity of deformation requires that the velocity fields in the deformation zone be controlled. In the extrusion process, for example, use of streamlined dies was found to be highly beneficial.

The present invention therefore provides a novel method for hot forming articles utilizing techniques wherein hot workability of the material may be optimized using processing maps which predict response of a given material to the hot metalworking process and the resulting microstructure of the formed material. The invention has particular application to high strength, high temperature, difficult to process metals and alloys, the response prediction being represented as a dynamic model developed by considering the workpiece as a dissipator of power in the total processing system. It is understood that certain modifications to the invention as described may be made, as might occur to one with skill in the field of this invention, within the scope of the appended claims. Therefore, all embodiments contemplated hereunder which achieve the objects of the invention have not been shown in complete detail. Other embodiments may be developed without departing from the spirit of the invention or from the scope of the appended claims.

We claim:

1. A method of fabricating an article from a metallic material, comprising the steps of:

a. generating flow stress data as a function of strain rate and temperature on samples of said material at predetermined strain within predetermined ranges of temperature and strain rate;

b. determining from said data the strain rate sensitivity and defining power dissipation efficiency as a function of temperature and strain rate for said material within said ranges of temperature and strain rate;

c. selecting values of strain rate and corresponding temperature for a selected value of said power dissipation efficiency; and d. hot forming said material at said selected strain rate and temperature values to a predetermined shape for said article.

2. The method recited in claim 1 wherein said hot forming includes hot forging said material.

3. The method recited in claim 1 wherein said hot forming includes hot extruding said material.

4. The method recited in claim 1 wherein said hot forming includes hot rolling said material.

5. The method recited in claim 1 wherein said material is a metal selected from the group consisting of titanium, aluminum, nickel, cobalt, copper, iron and zirconium.

6. The method recited in claim 1 wherein said material is a an alloy of a metal selected from the group consisting of titanium, aluminum, nickel, cobalt, copper, iron and zirconium.

7. The method recited in claim 1 wherein said material comprises titanium, and said hot forming is performed at a temperature of about 1000° K. at a strain rate of about $3.3\times10^{-2}\,s^{-1}$.

8. The method recited in claim 1 wherein said material comprises aluminum, and said hot forming is performed at a temperature of about 823° K. at a strain rate of about 50 $s^{-1}$.

9. The method recited in claim 1 wherein said material comprises nickel, and said hot forming is performed at a temperature of about 1270° K. at a strain rate of about 4 $s^{-1}$.

10. The method recited in claim 1 wherein said material comprises cobalt, and said hot forming is performed at a temperature of about 1273° K. at a strain rate of about 3.4 $s^{-1}$.

11. The method recited in claim 1 wherein said material comprises copper, and said hot forming is performed at a temperature of about 976° K. at a strain rate of about $4.5\times10^{-4}\,s^{-1}$.

12. The method recited in claim 1 wherein said material comprises $\alpha$-iron, and said hot forming is performed at a temperature of about 1123° K. at a strain rate of from $10^{-3}$ to about $10^{-2}\,s^{-1}$.

13. The method recited in claim 1 wherein said material comprises $\alpha$-zirconium, and said hot forming is performed at a temperature of about 933° K. at a strain rate of about 67 $s^{-1}$.

14. The method recited in claim 1 wherein said material comprises $\beta$-zirconium, and said hot forming is performed at a temperature of about 1200° K. at a strain rate of about 67 $s^{-1}$.

15. The method recited in claim 1 wherein said material comprises $\alpha+\beta$ Ti-6242 alloy, and said hot forming is performed at a temperature of about 927° C. at a strain rate of about $10^{-3}$ $s^{-1}$.

16. The method recited in claim 1 wherein said material comprises transformed $\beta$ Ti-6242 alloy, and said hot forming is performed at a temperature of about 927° C. at at strain rate of about $10^{-3}$ $s^{-1}$.

17. The method recited in claim 1 wherein said material comprises Rene-95 nickel base superalloy, and said hot forming is performed at a temperature of about 1850° F. and a strain rate of about 0.4 $s^{-1}$.

18. The method recited in claim 1 wherein said material comprises IN-100 nickel base superalloy, and said hot forming is performed at a temperature of about 1080° C. at a strain rate of about 0.05 $s^{-1}$.

19. In a method for hot forming a material including metals, alloys and the like, an improvement wherein optimum processing parameters are preselected for performing said hot forming, said improvement comprising the steps of:

a. generating flow stress data as a function of strain rate and temperature on samples of said material at predetermined strain within predetermined ranges of temperature and strain rate;

b. determining from said data the strain rate sensitivity and defining power dissipation efficiency as a function of temperature and strain rate for said material within said ranges of temperature and strain rate; and c. selecting values of strain rate and corresponding temperature for a selected value of said power dissipation efficiency at which values said hot forming is to be performed.

20. The method recited in claim 19 wherein said hot forming includes hot forging said material.

21. The method recited in claim 19 wherein said hot forming includes hot extruding said material.

22. The method recited in claim 19 wherein said hot forming includes hot rolling said material.

23. The method recited in claim 19 wherein said material is a metal selected from the group consisting of titanium, aluminum, nickel, cobalt, copper, iron and zirconium.

24. The method recited in claim 19 wherein said material is a an alloy of a metal selected from the group consisting of titanium, aluminum, nickel, cobalt, copper, iron and zirconium.

25. The method recited in claim 19 wherein said material comprises titanium, and said hot forming is performed at a temperature of about 1000° K. at a strain rate of about $3.3\times10^{-2}$ $s^{-1}$.

26. The method recited in claim 19 wherein said material comprises aluminum, and said hot forming is performed at a temperature of about 823° K. at a strain rate of about 50 $s^{-1}$.

27. The method recited in claim 19 wherein said material comprises nickel, and said hot forming is performed at a temperature of about 1270° K. at a strain rate of about 4 $s^{-1}$.

28. The method recited in claim 19 wherein said material comprises cobalt, and said hot forming is performed at a temperature of about 1273° K. at a strain rate of about 3.4 $s^{-1}$.

29. The method recited in claim 19 wherein said material comprises copper, and said hot forming is performed at a temperature of about 976° K. at a strain rate of about $4.5\times10^{-4}$ $s^{-1}$.

30. The method recited in claim 19 wherein said material comprises $\alpha$-iron, and said hot forming is performed at a temperature of about 1123° K. at a strain rate of from about $10^{-3}$ to about $10^{-2}$ $s^{-1}$.

31. The method recited in claim 19 wherein said material comprises $\alpha$-zirconium, and said hot forming is performed at a temperature of about 933° K. at a strain rate of about 67 $s^{-1}$.

32. The method recited in claim 19 wherein said material comprises $\beta$-zirconium, and said hot forming is performed at a temperature of about 1200° K. at a strain rate of about 67 $s^{-1}$.

33. The method recited in claim 19 wherein said material comprises $\alpha+\beta$ Ti-6242 alloy, and said hot forming is performed at a temperature of about 927° C. at a strain rate of about $10^{-3}$ $s^{-1}$.

34. The method recited in claim 19 wherein said material comprises transformed $\beta$ Ti-6242 alloy, and said hot forming is performed at a temperature of about 927° C. at a strain rate of about $10^{-3}$ $s^{-1}$.

35. The method recited in claim 19 wherein said material comprises Rene-95 nickel base superalloy, and said hot forming is performed at a temperature of about 1850° F. at a strain rate of about 0.4 $s^{-1}$.

36. The method recited in claim 19 wherein said material comprises IN-100 nickel base superalloy, and said hot forming is performed at a temperature of about 1080° at a strain rate of about 0.5 $s^{-1}$.

37. A method for generating a processing map for displaying process parameters for hot forming a material including metals, alloys and the like, and from which optimum processing parameters for performing said hot forming are preselected, comprising the steps of:

a. generating flow stress data as a function of strain rate and temperature on samples of said material at predetermined strain within predetermined ranges of temperature and strain rate;

b. determining from said data the strain rate sensitivity and defining power dissipation efficiency as a function of temperature and strain rate for said material within said ranges of temperature and strain rate; and c. mapping values of said power dissipation efficiency versus corresponding values of temperature and strain rate from said generated data on a plot displaying constant power dissipation efficiency contours.

38. The method recited in claim 37 wherein said material is a metal selected from the group consisting of titanium, aluminum, nickel, cobalt, copper, iron and zirconium.

39. The method recited in claim 37 wherein said material is a an alloy of a metal selected from the group consisting of titanium, aluminum, nickel, cobalt, copper, iron and zirconium.

40. The method recited in claim 39 wherein said material comprises an alloy selected from the group consisting of $\alpha+\beta$ Ti-6242 alloy, $\beta$ Ti-6242 alloy, Rene-95 nickel base superalloy, and IN-100 nickel base superalloy.

* * * * *